US008356641B2

(12) United States Patent
Marelin et al.

(10) Patent No.: US 8,356,641 B2
(45) Date of Patent: Jan. 22, 2013

(54) STATIONARY BAND CLAMPING APPARATUS

(75) Inventors: Miklos Balazs Marelin, Aurora, CO (US); Rene Leist, Denver, CO (US); Casey James Dorneman, Denver, CO (US); Daniel J. Nelson, Denver, CO (US)

(73) Assignee: Band-It-IDEX, Inc., Denver, CO (US)

( * ) Notice: Subject to any disclaimer, the term of this patent is extended or adjusted under 35 U.S.C. 154(b) by 1102 days.

(21) Appl. No.: 12/251,861

(22) Filed: Oct. 15, 2008

(65) Prior Publication Data

US 2009/0114308 A1 May 7, 2009

Related U.S. Application Data

(60) Provisional application No. 61/035,999, filed on Mar. 12, 2008, provisional application No. 60/985,142, filed on Nov. 2, 2007.

(51) Int. Cl.
*B21F 9/02* (2006.01)

(52) U.S. Cl. ..... 140/93.4; 140/152; 140/93.2

(58) Field of Classification Search ..... 140/111, 140/113, 117, 93.2, 93.4, 93 R, 93.6, 123.5, 140/123.6, 152, 150; 100/29, 32, 33 PB, 100/33 R; 53/135.1, 415
See application file for complete search history.

(56) References Cited

U.S. PATENT DOCUMENTS

| | | | |
|---|---|---|---|
| 19,709 | A | 3/1858 | Olmstead |
| 25,125 | A | 8/1859 | Knowles |
| 43,494 | A | 7/1864 | Hanvey |
| 51,214 | A | 11/1865 | Quant |
| 134,052 | A | 12/1872 | Gurley |
| 155,413 | A | 9/1874 | Boisseau |
| 188,669 | A | 3/1877 | Pollard |
| 193,946 | A | 8/1877 | Hamilton |
| 196,432 | A | 10/1877 | Chapman |
| 204,965 | A | 6/1878 | Gilman |
| 296,686 | A | 4/1884 | Gresham |
| 356,083 | A | 1/1887 | Schrader et al. |
| 359,686 | A | 3/1887 | Noyes |
| 980,700 | A | 1/1911 | Swafford |
| 997,186 | A | 7/1911 | Flora |
| 1,000,083 | A | 8/1911 | Flora |
| 1,277,076 | A | 8/1918 | Ireland |
| RE14,762 | E | 11/1919 | Springer |
| 1,330,705 | A | 2/1920 | Herrick |

(Continued)

FOREIGN PATENT DOCUMENTS

| | | |
|---|---|---|
| BE | 563228 | 12/1957 |
| CA | 658135 | 2/1963 |

(Continued)

OTHER PUBLICATIONS

Hogan, "Ball-Locking System secures stainless steel tie", Design News, Apr. 6, 1981, pp. 1-2.

(Continued)

*Primary Examiner* — Dana Ross
*Assistant Examiner* — Pradeep C Battula
(74) *Attorney, Agent, or Firm* — Sheridan Ross P.C.

(57) ABSTRACT

A tensioning device is provided that includes a separable punching and cutting mechanism. Provided is an impact head that holds a buckle while the band that resides within the buckle is tensioned. After a predetermined tension is achieved, a mechanism is used to lock the band with respect to the buckle then to cut the band. Various data related to tension and cutting performance may also be outputted by the invention.

57 Claims, 17 Drawing Sheets

U.S. PATENT DOCUMENTS 1,482,247 A 1/1924 Nowland
1,555,819 A 10/1925 Baruch
1,565,865 A 12/1925 Ragona
1,600,833 A 9/1926 McChesney
1,649,363 A 11/1927 Parsons
1,670,201 A 5/1928 McGary
1,712,037 A 5/1929 Halter
1,772,678 A 8/1930 Newton
1,849,784 A 3/1932 Birch et al.
1,887,732 A 11/1932 Pagel et al.
1,948,719 A 2/1934 King
1,973,823 A 9/1934 Monten
1,989,669 A 2/1935 Harvey
1,990,820 A 2/1935 Flader
2,007,002 A 7/1935 Porter
2,046,634 A 7/1936 Johnson
2,075,720 A 3/1937 Hoffmann
2,087,655 A 7/1937 Prestwich
2,115,736 A 5/1938 McAneny
2,118,158 A 5/1938 Ott
2,192,979 A 3/1940 McAneny, Jr.
2,208,114 A 7/1940 Campbell
2,208,134 A 7/1940 McAneny
2,210,510 A 8/1940 Sutton
2,214,110 A 9/1940 Ott
D123,270 S 10/1940 Mahn
2,312,400 A 3/1943 Govanus
2,312,575 A 3/1943 McKee
2,318,946 A 5/1943 Kass
2,324,609 A 7/1943 Watt et al.
2,349,608 A 5/1944 Bramble
2,426,731 A 9/1947 Elliot
2,536,536 A 1/1951 Childress et al.
2,551,384 A 5/1951 Middleton et al.
2,641,470 A 6/1953 Friedl
2,643,687 A 6/1953 Schlage et al.
2,837,494 A 6/1958 Gilbert et al.
2,870,503 A 1/1959 McAneny
2,871,738 A 2/1959 Abbiati
2,882,934 A 4/1959 Gerrard
2,928,434 A 3/1960 McAneny
2,967,550 A 1/1961 Rosenberger et al.
2,998,629 A 9/1961 Smith
3,015,865 A 1/1962 Rapuzzi
3,061,302 A 10/1962 Dennis
3,067,640 A 12/1962 Lodholm
3,014,256 A 12/1963 Derrickson et al.
3,112,496 A 12/1963 Dritz
3,117,812 A 1/1964 Brooks et al.
3,152,621 A 10/1964 Meier
3,197,829 A 8/1965 Caveney et al.
3,241,579 A 3/1966 Partridge
3,242,542 A 3/1966 Tako
3,261,062 A 7/1966 Scarborough, Jr.
3,329,178 A 7/1967 Plunkett
3,344,815 A 10/1967 Lawson et al.
3,396,760 A 8/1968 Kirsinas et al.
3,552,450 A 1/1971 Plunkett
3,596,686 A 8/1971 Blumenfeld et al.
3,610,296 A 10/1971 Kabel
3,653,099 A 4/1972 Hoffman
3,660,869 A 5/1972 Caveney et al.
3,682,030 A 8/1972 Harris
3,735,784 A 5/1973 Obuch et al.
3,748,697 A 7/1973 Marchese et al.
3,754,303 A 8/1973 Pollock
3,782,426 A 1/1974 Morgan et al.
3,833,969 A 9/1974 Hollingsworth et al.
3,837,211 A 9/1974 Gress et al.
3,866,812 A 2/1975 Gutjahr
3,909,884 A 10/1975 Weckesser
3,964,133 A 6/1976 Wasserlien, Jr.
4,011,807 A 3/1977 Kobiella
4,015,311 A 4/1977 Curtis
4,041,993 A 8/1977 Angarola
4,047,545 A 9/1977 Paradis
4,056,128 A 11/1977 Konrad
4,083,086 A 4/1978 Oetiker
4,091,511 A 5/1978 Reddy
4,106,799 A 8/1978 Oetiker
4,128,919 A 12/1978 Bulanda et al.
4,222,155 A 9/1980 Oetiker
4,245,678 A * 1/1981 Sansum ..... 140/93.4
4,272,870 A 6/1981 McCormick
4,333,210 A 6/1982 Burnett
4,366,602 A 1/1983 Conlon et al.
4,380,255 A 4/1983 Fromm
4,390,047 A 6/1983 Kaneko
4,399,592 A 8/1983 Chopp, Jr. et al.
4,418,448 A 12/1983 Sauer
4,450,032 A 5/1984 Wehr
4,473,925 A 10/1984 Jansen
4,492,004 A 1/1985 Oetiker
4,507,828 A 4/1985 Furutsu
4,567,626 A 2/1986 Kimbrough
4,570,340 A 2/1986 Shaw
4,607,867 A 8/1986 Jansen
4,631,782 A 12/1986 Gecs
4,646,393 A 3/1987 Young
4,646,591 A 3/1987 Jansen
4,696,327 A 9/1987 Wolcott
4,726,403 A 2/1988 Young et al.
4,733,701 A 3/1988 Loisel et al.
4,747,433 A 5/1988 Dixon
4,765,032 A 8/1988 Fortsch
4,793,385 A 12/1988 Dyer et al.
4,887,334 A 12/1989 Jansen et al.
4,896,402 A 1/1990 Jansen et al.
4,901,404 A 2/1990 Mizukoshi et al.
4,928,738 A 5/1990 Marelin et al.
4,934,416 A 6/1990 Tonkiss
4,947,901 A 8/1990 Rancour et al.
4,997,011 A 3/1991 Dyer et al.
5,000,232 A 3/1991 Wolcott
5,007,465 A 4/1991 Tonkiss
5,024,149 A 6/1991 Kato
5,123,456 A 6/1992 Jansen
5,127,446 A 7/1992 Marelin
5,129,350 A 7/1992 Marelin
5,146,847 A 9/1992 Lyon et al.
5,163,482 A 11/1992 Wolcott
5,203,786 A 4/1993 Vernick
5,251,360 A 10/1993 Putz
5,291,637 A 3/1994 Meyers
5,293,668 A 3/1994 Tibiletti
5,303,571 A 4/1994 Quinn et al.
5,322,091 A 6/1994 Marelin
5,377,477 A 1/1995 Haberstroh et al.
5,452,523 A 9/1995 Jansen
5,483,998 A 1/1996 Marelin et al.
5,488,760 A 2/1996 Jansen
5,533,235 A 7/1996 Fukuda
5,566,726 A 10/1996 Marelin
5,628,348 A 5/1997 Scott et al.
5,644,819 A 7/1997 Lyons
5,647,407 A 7/1997 Scott et al.
5,647,563 A 7/1997 Gantner et al.
5,732,446 A 3/1998 Blanks
5,743,310 A 4/1998 Moran
5,850,674 A 12/1998 Jansen
6,014,792 A 1/2000 Marelin et al.
6,038,967 A 3/2000 Chak et al.
6,041,581 A 3/2000 Huber
6,073,664 A 6/2000 Angarola
6,122,804 A 9/2000 Gamaggio-Schafer
6,302,157 B1 10/2001 Deschenes et al.
6,345,648 B1 * 2/2002 Cheung ..... 140/93.2
6,457,212 B1 10/2002 Craig
6,481,467 B2 11/2002 Czebatul
6,615,879 B2 9/2003 Kurmis
6,668,427 B2 12/2003 Bulanda et al.
7,373,695 B2 5/2008 Caveney et al.
7,484,274 B2 2/2009 Nelson et al.
7,650,680 B2 1/2010 Stillings et al.
7,866,007 B2 1/2011 DeBerry et al.

| | | | |
|---|---|---|---|
| 2006/0266230 | A1 | 11/2006 | Vereschagin |
| 2006/0272133 | A1 | 12/2006 | Ingalls et al. |
| 2007/0084022 | A1 | 4/2007 | Stillings |

FOREIGN PATENT DOCUMENTS

| | | |
|---|---|---|
| CH | 403620 | 11/1965 |
| CH | 594821 | 1/1978 |
| CH | 655069 | 3/1986 |
| CH | 663995 | 1/1988 |
| DE | 571789 | 2/1933 |
| DE | 1268077 | 2/1962 |
| DE | 2036802 | 2/1971 |
| DE | 2007232 | 9/1971 |
| DE | 2534156 | 2/1977 |
| DE | 2825522 | 12/1979 |
| DE | 19805062 | 8/1999 |
| EP | 0174410 | 3/1986 |
| EP | 0353011 | 1/1990 |
| EP | 0479602 | 4/1992 |
| EP | 0479623 | 4/1992 |
| EP | 0579432 | 1/1994 |
| EP | 0687528 | 12/1995 |
| EP | 0758616 | 2/1997 |
| EP | 0806349 | 11/1997 |
| EP | 1043230 | 10/2000 |
| EP | 1151921 | 11/2001 |
| EP | 1231140 | 8/2002 |
| EP | 1359357 | 11/2003 |
| EP | 1489005 | 12/2004 |
| EP | 1537800 | 6/2005 |
| FR | 1175067 | 5/1957 |
| FR | 1443078 | 6/1966 |
| FR | 2044175 | 2/1971 |
| FR | 2111309 | 6/1972 |
| GB | 730984 | 6/1955 |
| GB | 932116 | 7/1963 |
| GB | 1025811 | 4/1966 |
| GB | 1030707 | 5/1966 |
| GB | 1048598 | 11/1966 |
| GB | 1068993 | 5/1967 |
| NL | 7408399 | 12/1975 |
| RU | 1836749 | 8/1993 |
| SU | 1495238 | 7/1989 |
| WO | WO 82/02035 | 6/1982 |
| WO | WO 96/27526 | 9/1996 |
| WO | WO 2006/128146 | 11/2006 |

OTHER PUBLICATIONS

"Scru-Band Scru-Seal™ Clamps Clamp-Pak™", Band-It® Catalog, pp. 18-19.

"Multi-Lok Ties: Self-Locking Multi-Lok Ties", p. 8.

Strapping, Stretch Wrapping and Tape Protection Packaging Systems Catalog, Signode, May 8, 2007, pp. 1-4.

"Steel Strapping, Seals and Tools", Certified Slings and Supply website, as early as 2006, available at http://www.certifiedslings.com/catalog/8-SteelStrappingSealsTools.shtml, printed on Apr. 16, 2009, pp. 1-2.

"Steel Strapping, Seals and Packaging Tools", Modern International Corporation website, as early as May 5, 2002, available at http://www.moderninternational.com/strapping/steel.htm, printed on Jun. 28, 2007, pp. 1-4.

International Search Report for International (PCT) Application No. PCT/US09/37000, mailed May 4, 2009.

Written Opinion for International (PCT) Application No. PCT/US09/37000, mailed May 4, 2009.

"Datasheet A480" FROMM Packaging Systems, Mar. 9, 2007, 2 pages.

Official Action for Canada Patent Application No. 2,718,061, mailed Apr. 4, 2012 3 pages.

Extended European Search Report for European Patent Application No. 07122382.0, dated Feb. 18, 2010.

International Preliminary Report on Patentability for International (PCT) Patent Application No. PCT/US2009/037000, mailed Sep. 23, 2010.

Examination Report and Notice of Acceptance for New Zealand Patent Application No. 588447, mailed on Apr. 24, 2012.

Extended Search Report for European Patent Application No. 09720677.5, dated Jun. 11, 2012 4 pages.

"Operators Manual Repair Parts List Automatic S350 Auto Air Tool", Band-it, A Unit of IDEX Corporation, 1999, pp. 1-38.

IDEX Corporation, "Automatic Air Tool S350", p. 15, 2000, Band-It The Clamping Experts, Jul. 2000, pp. 1-4.

"IT9000 Bench Mounted Electric Tool Specifications", Band-It, The Clamping experts, date unknown, pp. 1-8.

"Simple Solution to a Complex Problem: Electro Adapter, Inc. Introduces CBS Calibrated Banding System", Electro Adapter, Inc. pp. 1-4.

"Yesterday, Today and Tomorrow Sunbank Meets the Challenge", Sunbank Electronics, Inc., pp. 1-4.

* cited by examiner

STATIONARY BAND CLAMPING APPARATUS

CROSS-REFERENCE TO RELATED APPLICATIONS

This patent application claims the benefit of pending U.S. Provisional Patent Application Ser. No. 61/035,999, filed Mar. 12, 2008 entitled "Stationary Band Clamping Apparatus," the entire disclosure of which is incorporated by reference herein. This patent application also claims the benefit of pending U.S. Provisional Patent Application Ser. No. 60/985,142, filed Nov. 2, 2007 entitled "Dual Locking General Purpose Clip and Method of Forming the Same," the entire disclosure of which is incorporated by reference herein.

This patent application is related to U.S. Pat. No. 5,123,456 issued Jun. 23, 1992, entitled "Banding Tool Including Clamping Plunger" and U.S. Pat. No. 6,481,467 issued Nov. 19, 2002, entitled "Powered Band Clamping Under Electrical Control," both being incorporated by reference in their entirety herein.

FIELD OF THE INVENTION

Embodiments of the present invention are related generally to banding tools, and in particular to a method and apparatus for tensioning a band with a tool having separate locking and cutting mechanisms that allows for a smaller dimensioned tool, which enhances access to a greater variety of work pieces, and that reduces impact forces felt by the work piece. The tool of the present invention accommodates a variety of band and lock styles. Embodiments of the present invention also include data output functionality, sensors and feedback mechanisms to ascertain performance and predict problems or maintenance issues.

BACKGROUND OF THE INVENTION

Many types of bands have been devised or advanced for use in clamping objects, such as hoses, pipes, poles, cables and the like. Bands generally are combined with an associated buckle, clasp, clamp, seal or other locking member (collectively referred to herein as a buckle for simplicity) that maintains the wrapped band in a tensioned state about one or more objects. The buckle may be separate from or integral with the band. Bands may be pre-formed prior to installation, in which the band is wrapped about itself to form a closed loop, with the leading or free end of the band positioned through and extending away from the buckle. Such pre-formed bands are subsequently placed about a work piece, i.e., the objects to be bound, and then fully tightened using a clamping tool. Alternatively, some bands are not pre-formed but include a free end that is initially wrapped about the work piece to form a closed loop about the work piece, wherein the leading or free end is then introduced into the buckle by the operator. A tool is typically used to complete tensioning to the desired or specified level.

Various devices have been implemented or disclosed that are intended to enhance or facilitate band tensioning. These devices may be stationary or fixed in position or they may be hand-held. In many instances, such devices also cut off the leading portion of the band after it has been tensioned and create the lock between the band and buckle that maintains the desired tension of the band about the clamped object. Devices that perform the tightening, locking and cutting functions may be manual, pneumatic, electric or a combination thereof in operation. Pneumatic and electric devices accomplish the tasks of tensioning, locking and cutting with limited or reduced human effort. Band tightening devices that are pneumatic or electric are usually semiautomatic in that the operator is required to perform some, but not all, of the tasks or associated operations. Manual tasks that remain may include locating the band about the object, inserting or otherwise locating the leading end of the band relative to or through a buckle and positioning the leading end in a tensioning device to initiate tightening of the band about a work piece. In one known pneumatic band tightening apparatus, a desired tension is preset. A pneumatic cylinder is activated to engage and pull on the band until a desired band tension is reached. Pneumatic control may also be involved in forming the lock and cutting the excess leading end portion after the band is tightened and secured with the buckle.

Although a variety of clamping devices have been designed for use with bands of various sizes, it would be advantageous to provide a device that achieves greater control over the band clamping operations. Such a device should be effective and efficient in tightening the band, forming the lock or clamping function and automatically cutting and removing the excess leading portion after the band is locked. Furthermore, it would be beneficial for such a device to be easily used by the operator in connection with positioning of the clamping device relative to the work piece, including facilitating insertion or engagement of the band to the device. It would also be advantageous to provide a device that locks the band relative to the buckle and cuts the tail of the band in an efficient manner that reduces shock loads while collecting and outputting relevant process data related to installation of each band to verify and distinguish between a properly or improperly installed band and/or to identify maintenance issues with respect to the tool.

SUMMARY OF THE INVENTION

It is one aspect of the present invention to provide an adjustably mounted clamping tool or device. More specifically, embodiments of the present invention are interconnected to a stationary slide that allows movement of the tool relative to a fixed base. Further, the clamping device is also capable of pivoting with respect to the base. This functionality allows the operator to more easily access bulky or cumbersome work pieces. For example, with the work piece secured in a vise or otherwise stabilized, the clamping device or tool may then be positioned relative to the object being clamped. The operator is not required to manipulate the position of a work piece relative to the clamping tool. This functionality allows the tool to be placed closer to the work piece and allows for more accurate placement and securement of the band about the object. Further, the adjustable positioning provided by embodiments of the present invention enhances operational repeatability when conducting the same clamping operation over and over.

In one embodiment of the present invention, a gripping mechanism or subassembly will engage a leading end portion of a looped band that has previously been fed through a buckle and placed about a work piece. Once gripped, the band is then tightened about the work piece by a belt tightening mechanism. During tightening, the buckle is secured and restrained by a portion of the tool in preparation for locking the band with respect to the buckle. In a separate process, a punch mechanism or subassembly deforms the band and/or the buckle to secure the band about the workpiece with the desired clamping force and a cutting mechanism or subassembly cuts the excess leading portion of the band.

It is another aspect of the present invention to provide a clamping device utilizing a pair of opposed wheels to grip and tension the band. In one embodiment, one wheel (the tension wheel) is fixed in position and the other wheel (the pinch wheel or backing wheel) is movable to pinch the band between the two wheels. Preferably, both wheels are provided with a textured surface to engage and grip the surface of the band. One or both of the textured surfaces may form a series of teeth or edges that are positioned at an angle relative to the surface of the band to facilitate gripping and tensioning. However, the teeth or edges may have a tendency to puncture or cut the band as it is tensioned, particularly if the teeth or edges of the teeth extend continuously or near continuously across the entire width of the band, which essentially creates a knife edge across the width of the band. More specifically, the teeth or edges may deform the band by reducing or thinning the cross-sectional area of the band. This reduction of the cross-sectional area will increase the axial stress on the band at this weakened area during tensioning, which may cause premature breaking with the band under tension. For this reason, it is preferred not to have teeth or edges that extend across the entire engaging surface of the tension wheel. Therefore, one or more circumferential grooves may be formed in the textured pattern to create a discontinuity in the edges formed by the teeth. Embodiments of the present invention thus employ a tension wheel having an engaging surface with non-continuous teeth relative to the width of the band, thereby addressing this problem.

As previously noted, it is desirable that the engaging surfaces of both the tension and pinch wheels are textured. If the tension wheel is textured with a toothed pattern, the pinch wheel is preferably provided with a diamond patterned surface. As compared to a toothed pattern, a diamond pattern typically is formed by pyramid shaped teeth whose apex may be a point rather than an edge. Some embodiments of the present invention may employ an apex comprising a concave, convex or planar surface. Further, other pyramid-like shapes may be used without departing from the scope of the invention, such as a tetrahedron (three-sided pyramid), a five-sided pyramid, etc. When a diamond pattern is formed on the pinch wheel and a toothed pattern is formed on the opposed tension wheel, it is a related aspect of the present invention to stagger the diamond pattern relative to the toothed pattern such that the apex of the teeth and the apex of pyramids forming the diamond pattern are not aligned. For example, the edges formed by the teeth of the tension wheel and the points formed by the diamond pattern of the pinch wheel are positioned such that the points of the diamond pattern are aligned with the space or gaps between successive edges of the toothed pattern, as opposed to a configuration where the points and edges are aligned to abut each other. This configuration reduces the chances of thinning and severing the band prematurely. It should also be appreciated that the diamond pattern may be formed on the tension wheel and that the toothed pattern may be formed on the pinch wheel. Alternatively, other textured patterns may be appropriate as well.

There are advantages that come from texturing the surface of both the tension and pinch wheels. For example, placing a texture pattern on each wheel also produces less metal shavings. In prior art devices, where one wheel employs a textured surface and the other wheel employs a smooth surface, the smooth surface is susceptible to slipping on the band, which can create metal shavings. Over time, the shavings may fill the gaps between the rows of teeth in the textured pattern of the opposed wheel, thereby decreasing the gripping action of the teeth of the opposed wheel. Also, by offsetting the edges of the tension wheel teeth and the points of the diamond surface of the pinch wheel, the points and teeth tend to self clean the spaces or gaps between the teeth and the points to reduce the accumulation of shavings and prolong the life of the wheels.

Another advantage of the opposed surface patterns of the tension and pinch wheels is derived from cold working both surfaces of the band. In prior art devices, which utilize one smooth wheel in combination with a textured wheel, the surface of the band in contact with the textured wheel is subjected to a greater degree of cold working compared to the surface of the band in contact with the smooth surface of the exposed wheel. This one-sided or uneven cold working of the band causes it to excessively curl. Excessive curling can cause the band to re-enter the device and bind or jam the mechanics. By cold working both surfaces of the band to generally the same extent, due to both the tension and pinch wheel surfaces being textured, excessive curling of the band is reduced.

Embodiments of the present invention also employ a method of interconnecting the tension wheel to a drive shaft in a way that prevents the tension wheel from being mounted incorrectly, thereby avoiding the possibility that the textured surface of the tension wheel is incorrectly oriented. More specifically, tension wheels of the prior art are typically interconnected to their respective drive shafts via a traditional key and key-way method. However, this method of interconnection does not prohibit the tension wheel from being position on the drive shaft backwards. If the tension wheel is positioned on the shaft with the texturing pattern in the incorrect orientation, the band may not be adequately engaged or gripped since the texturing pattern will often be angled away from the band surface such that the tension wheel slips rather than engages the band surface. Also, the key traditionally used is an additional element or component that adds cost and complexity to assembly of the device. Embodiments of the present invention employ a tension wheel having an eccentric inner diameter and a correspondingly configured drive shaft that can only fit together in one way. In this manner, a component is eliminated and the tension wheel will always be correctly oriented with the textured pattern facing the proper direction.

It is yet another aspect of the present invention to provide an improved tensioning system that employs an automated and variable range of band pinching forces. As described above, a movable pinch wheel is used to press the band against the tension wheel in order to grip the band for tensioning. In order to achieve an effective pressing force, embodiments of the tensioning subassembly employ a pneumatic pinch cylinder interconnected to the pinch wheel via a toggle arm or pivoting pinch arm. One skilled in the art will appreciate that instead of a pneumatic cylinder, a servo motor, solenoid motor or other selective positioning method may be employed to transition the pinch wheel from a release position to an engaging position. As the pinch cylinder is actuated, the cylinder rod travels or extends outwardly. The pinch arm or toggle arm will then rotate about a pivot point, causing the opposite end of the pinch arm to move the pinch wheel into engagement with the band and to apply the requisite force needed for the tension wheel to grip the band. The length of the toggle arm and the location of the pivot can vary to increase or decrease the mechanical leverage of the pinch cylinder and thereby increase or decrease the force applied by the pinch wheel on the band. In addition, rather than having a set stroke length designed to apply a predetermined force to the band, the pinch cylinder is designed to have excess stroke length and is designed to halt travel of the cylinder rod when the desired force is applied to the band. A sensor or feedback loop associated with the pinch cylinder identifies when the desired force is applied and halts further travel of the cylinder rod. Importantly, the additional or excess stroke length permits the system to accommodate wear of the textured surfaces of the tension and/or pinch wheels. As wear occurs and the effective diameter of one or both wheels is reduced, additional stroke is available to move the pinch wheel closer to the tension wheel and thereby maintain appropriate gripping pressure on the band. Further, the stroke of the pinch cylinder may be automatically monitored over time and provide feedback concerning the wear of the tension and/or pinch wheels advising the operator of when it is time to replace one or both of the wheels before it may be visually obvious.

It is another aspect of the present invention to provide an improved system for tightening and adjusting the belt that drives the tension wheel. More specifically, prior art systems for band tensioning often utilize a tension wheel that is powered by a belt drive rather than directly powered by a motor. When a belt drive is used, the belt must be properly tensioned for the system to function correctly. Over time the belt drive may loosen, thereby reducing the effectiveness or ability of the motor and its associated drive wheel to rotate the tension wheel and effectively grip and tension the band. Alternatively, because the invention may be used with different sized bands, it may be desirable to apply different tensions. To maintain an appropriate tension on the drive belt, prior art belt tensioning systems typically use an adjustably positionable idler pulley in contact with the belt to remove slack. The idler pulley typically is repositionable in a slot oriented perpendicular to the path of the belt. Thus, as the idler pulley applies a tensioning force against the belt, the belt applies a reactive force against the idler pulley. A disadvantage of this configuration is that the full reactive force of the belt on the pulley is aligned with the slot in which the idler pulley is positioned and secured. As a result, the combination of vibration of the tool and the force of the belt acting on the idler pulley may eventually cause the mounting of the idler pulley to loosen and, once loosened, move the idler pulley in such a way that reduces the tension of the belt. Because of the orientation of the slot in which the idler pulley is mounted, the idler pulley can often only move directly away from the belt. Relatedly, it is also difficult to increase tension on the belt in these types of tensioning systems. The idler pulley may only move in a direction directly opposed to the reactive face of the belt. Making fine adjustments in the tension of the belt is difficult under these circumstances.

In comparison, embodiments of the present invention utilize at least one belt idler pulley positioned in a slot oriented parallel to the path of the belt, rather than perpendicular to the path of the belt. This orientation differs from the prior art in that the reactive force generated by the belt on the idler pulley is not fully aligned with the slot in which the idler pulley is mounted. Instead, the reactive force is oriented at an angle relative to the slot, with the component vectors of the belt reactive force oriented both perpendicular and parallel to the orientation of the adjustment slot. With this configuration, the loss of tension in the belt is reduced because only a portion of the reactive force applied by the belt on the pulley is in the direction of the adjustment slot while the remaining reactive force is in a direction that opposes movement of the idler pulley within the adjustment slot. Similarly, in the context of manually adjusting the tension of the belt, the present configuration facilitates tension adjustments. Because the adjustment slot runs parallel to the path of the belt, the idler pulley must be moved a greater distance to achieve the same tension adjustment as a configuration in which the slot is oriented perpendicular to the path of the belt. A longer distance in which to make adjustments allows for finer control and adjustment of tension pressure, which also requires less force to increase the tension on the drive belt since the reactive force generated by the belt does not fully oppose movement of the idler pulley within the adjustment slot.

It is another aspect of the present invention to accomplish punching and locking and cutting or severing the band in a two-step process. More specifically, embodiments of the present invention employ a cam-actuated system for additional control of the punching process that deforms a portion of the band to secure the position of the band relative to the buckle and the cutting process that removes the excess portion of the leading end of the band. This reduces the impact force generated by the punching and cutting operation which, in turn, reduces the impact on the workpiece and the shock felt by the operator. In one embodiment of the present invention, for example, the energy used to drive or power the punch is provided by a spring that is loaded and activated by the action of an associated cam. As the cam is rotated, the spring is loaded. Simultaneously, the punch is maintained in a locked position by at least one spring loaded lock pawl. As the cam continues to travel, impact arms separate the lock pawl(s) from the punch. The released energy of the spring then drives the punch into the band through an aperture in the buckle. In turn, this deforms the band and locks the band periphery relative to the buckle and the work piece.

The punch may also include an associated depth and alignment indicator to indicate that the punch has deformed the band to the requisite depth and that the punch is properly aligned relative to the band. In one embodiment, the punch is provided with a shoulder axially spaced away from the leading edge of the punch. The shoulder forms a ring around the deformed area or dimple in the band to give the operator the visual ability to ascertain the effectiveness of the punch. A symmetrical and fully formed ring indicates the punch properly deformed the band, that the punch was properly aligned relative to the band and that the desired retention force should be achieved. Conversely, a partial or asymmetrical ring indicates a depth and/or alignment problem, requiring the tool to be adjusted. It should be appreciated that the punch may be reconfigured to work with a variety of differently configured bands and buckles. In another embodiment of the invention, the punch may be provided with two separate shoulders spaced apart along the axis of the punch. One indicates a minimum depth of the dimple and the other indicates a maximum depth of the dimple. The quality of the dimple may be ascertained from the markings.

After the band has been punched, the cam continues its motion and interacts with the band cutting subassembly. More specifically, a rotary cutting blade is disposed underneath the band such that, upon further movement of the cam, the blade is caused to rotate and sever leading portions of the band. The motion of the blade also bends or wraps the end of the remaining portion of the band about the buckle forming a secondary or junior lock. The design configuration of the cutting mechanism also reduces the width of the tool increasing the ability of the tool to access a variety of differently shaped work pieces. The rotary-actuated cutting mechanism also reduces the overall height of the tool and resulting impact or shock generated during a cutting operation compared to a toggle-actuated guillotine-style cutting blade. These latter types of cutting mechanisms require a larger impact force to cut the band and also require a certain amount of overtravel of the blade to ensure that the band has been fully cut. Accommodating the overtravel requires a longer linear stroke of the blade which requires a larger housing. A larger impact force generates greater shock and vibration of the band, the tool and the work piece. In contrast, separating the punching and cutting operations reduces the impact loads experienced by the work piece and the operator from what it would be if both operations occurred simultaneously. It further allows the cam subassembly for the punch and cutting operations to be housed in a more compact manner, allowing the tool better improved access to a variety of differently shaped work pieces.

It is a related aspect of the present invention to facilitate clamping a band about a flat object or one that has a flat surface. That is, at least one embodiment of the present invention allows for the buckle to be positioned and held generally flat against a flat work piece. Unlike many prior art devices, the tensioning and locking scheme contemplated by embodiments of the present invention does not require that the buckle be lifted relative to the workpiece for tensioning or locking, which would raise the buckle from the flat surface and increase or lengthen the perimeter length of the band about the work piece resulting in a reduced retention force. By allowing the buckle to remain positioned against the surface of the work piece, the retention or clamping force of the band may be maintained at the desired amount. The ability to maintain the buckle and the band flat against the workpiece is also enhanced because the tail or leading portion of the band is pulled from the buckle at an angle.

It is another aspect of the present invention to monitor and measure multiple components of the overall system to enhance quality and performance of the clamping tool. A load cell associated with the various mechanical linkages forming the band tightening, punching and cutting subassemblies provides this feature. The output of the load cell may be customized to any unit of measurement without departing from the scope of the invention. Further, the output of the load cell may be provided as a function of time. For example, tension in the band over time may be monitored and output, maximum tension in the band may be monitored and output, tension in the band at cut off may be monitored and output, punch impact force may be monitored and output, and the amount of force needed to cut the band may be monitored and output. It is also envisioned that this output may be visual or audible. For example, the output of the load cell may be displayed on a monitor, such as in graphic form, wherein the operator can assess the performance of the tool throughout each cycle thereby monitoring performance and also identifying maintenance and/or repair issues. Lower than expected tension numbers during the band tightening process may suggest the occurrence of slipping tension and pinch wheels. As gripping wheels become worn, it may take longer for the tension to reach the desired level or the desired level may not be achieved. The operator and/or operating software may then identify problems before they influence the end product. In such a case, the tension and/or punch wheels may need replacing or cleaning or the belt drive of the tightening system may be a tension adjustment. Further, if the punch force is low or high, the punch may be misaligned or worn, or the spring member driving the punch may be incorrectly sized or worn. Similarly, when the amount of force needed to cut the band is increased, the cutting blade may need to be cleaned or replaced. The operating software may automatically shut down the tool if the measured data deviates from predetermined values or ranges. The outputted data may be sent to a remote industrial data acquisition and monitoring system or to any other system of displaying, outputting and/or analyzing information. The data may also be saved for long-term information analysis. For example, a running total of the number of bands tensioned and clamped may also be monitored which can provide helpful data for maintaining the tool. Moreover, these parameters may also be compared to optimal parameters for purposes of monitoring system functionality and performance. For example, the data may also be displayed in a graphic form on a monitor, together with an overlaid graph of an ideal load cell output to give an operator near instantaneous feedback.

It is another aspect of the present invention to provide electronic control of the gripping or band tightening mechanism. More specifically, the load cell may be used to ascertain the tension of the band and once the tension of the band achieves a predetermined amount, the punch is automatically activated and the band is cut. While prior art devices use pneumatics to control tensioning, embodiments of the present invention employ pneumatics to control the force applied by the pinch wheel and to control the punching and cutting of the band, but not to tension the band.

It is yet another aspect of the invention to provide a calibration device that may be interconnected to the tool to confirm and calibrate the accuracy of sensors used to measure the tension of the band. In one embodiment, the calibration device includes a sensor, a display and a length of band having one end connected to the sensor and the other end free. The free end is subjected to tensioning by the tool and the tension of the band is measured by the sensor and is displayed. The displayed tension measurement may then be compared to the tension specified for the tool during regular operation. Adjustments to the tool may be made based upon the comparison.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

FIG. 18A is a detailed view of FIG. 18.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
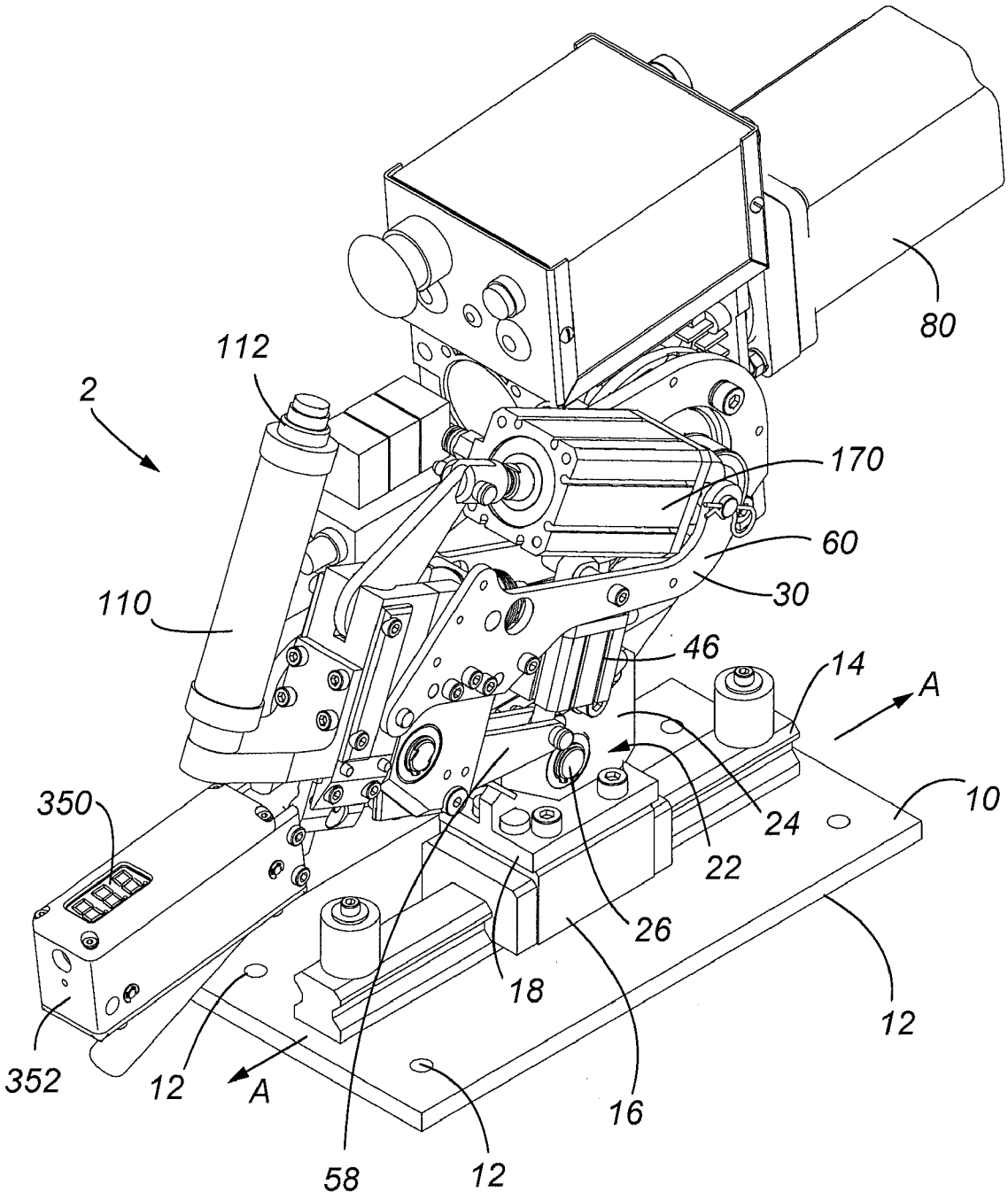
FIG. 1 is a perspective view of the tensioning device of one embodiment of the present invention shown with a calibration device interconnected thereto.
Figure 2:
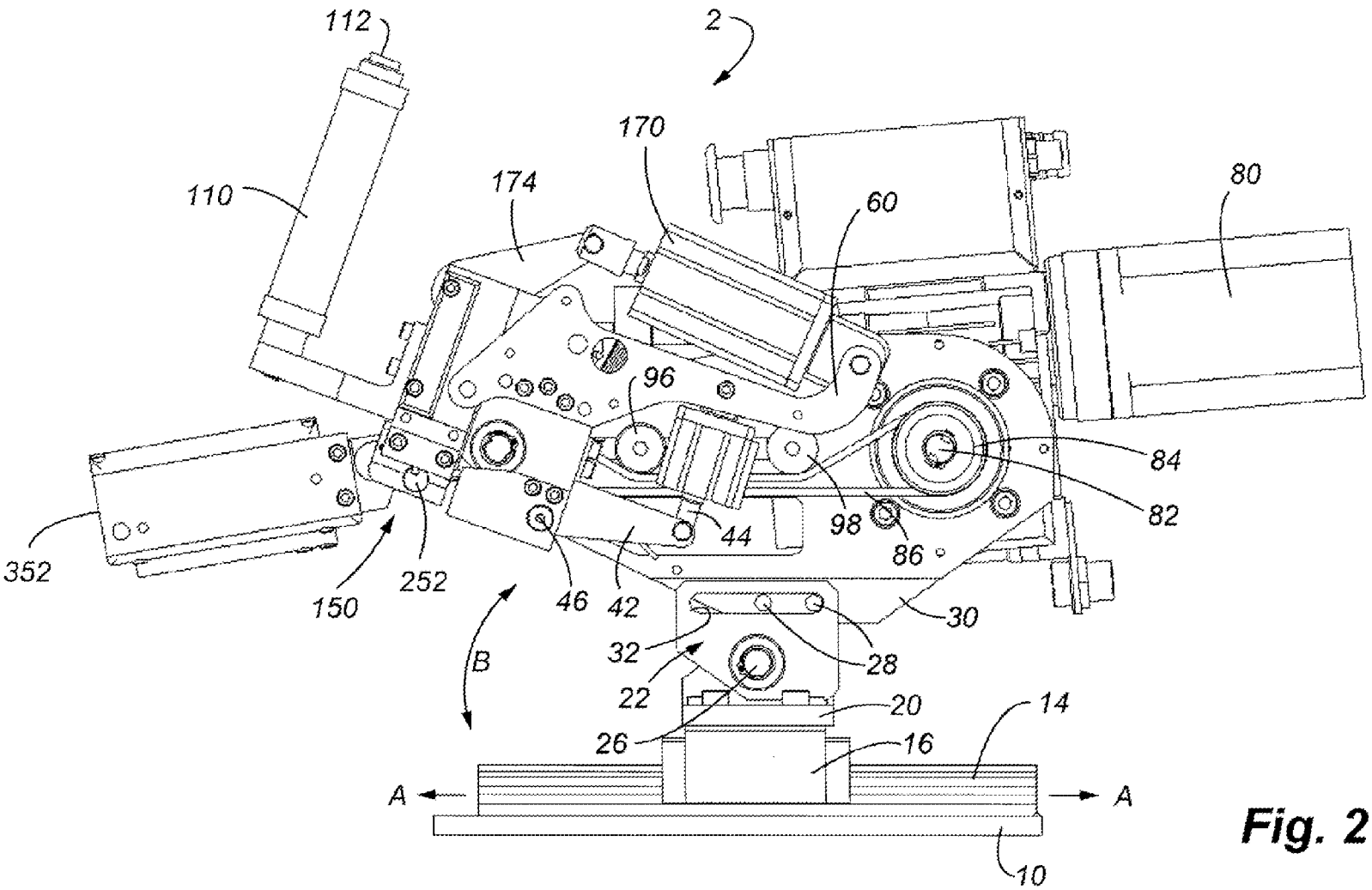
FIG. 2 is a front elevation view of the tensioning device.
Figure 3:
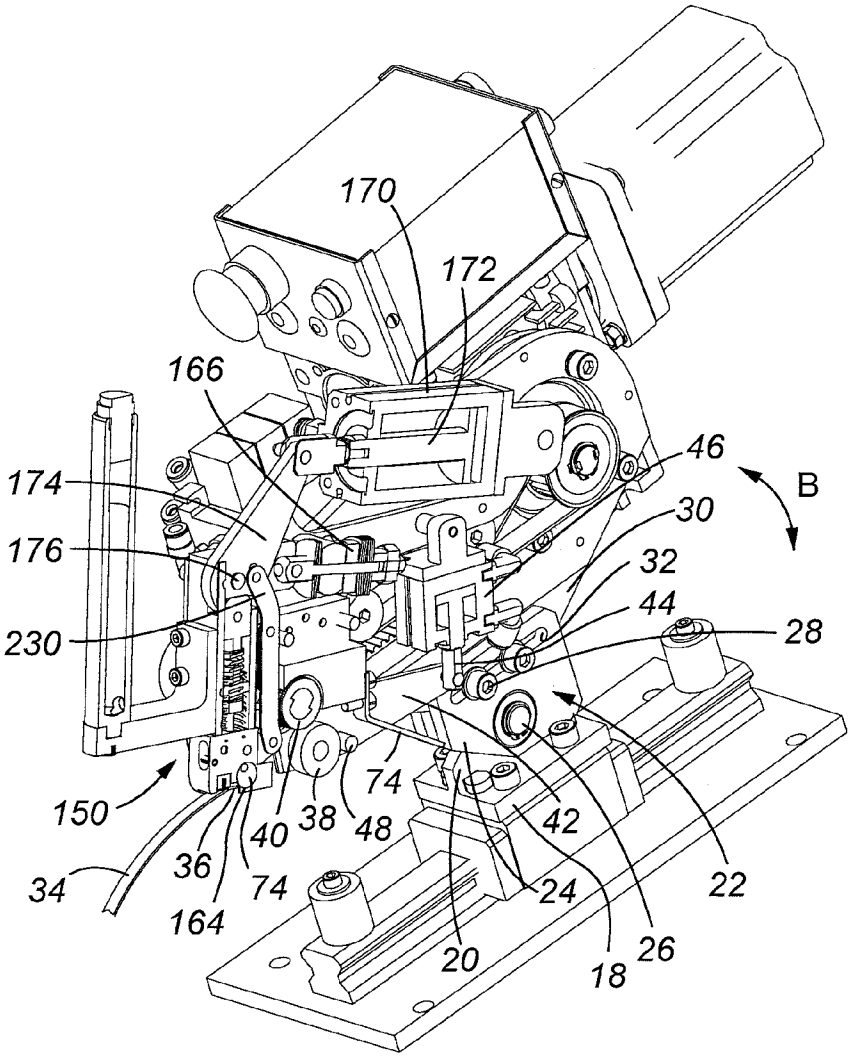
FIG. 3 is a detailed view of an impact member and tensioning mechanism of the tensioning device of one embodiment of the present invention.

Referring now to FIGS. 1-3, the tensioning device 2 of one embodiment of the invention is shown. The tension device or tool 2 includes a base 10 that is mountable to another structure via securement holes 12. A track or slide rail 14 is secured to the base 10. A slide mount 16 is slidably interconnected on the slide rail 14 and allows the tensioning device 2 to be moved relative to base 10 in the direction of arrow A (FIGS. 1 and 2). A mounting block 18 is secured to the slide mount 16. The mounting block 18 includes an upstanding plate 20 with an aperture (not shown) located generally in the center of the plate 20. A mounting bracket 22, formed by a pair of parallel spaced apart plates 24 straddle opposite sides of plate 20. Plates 24 include apertures such that a pivot or bearing 26 may be used to interconnect the three plates 22 and 24 to permit the device 2 to rotate or pivot relative to the fixed base 10 in the direction of arrow B (FIGS. 2 and 3). The mounting bracket 22 is, in turn, selectively interconnected to a primary frame 30 that supports the mechanical subassemblies of the tool 2. The position of the frame 30 may be adjusted relative to the mounting bracket 22 by adjusting bolts (not shown) positioned in apertures 28 formed in the frame 30 (FIG. 2). By mounting the tensioning device 2 in this manner, the tensioning device 2 may be adjustably positioned relative to its base 10 to accommodate differently shaped work pieces.

Figure 9:
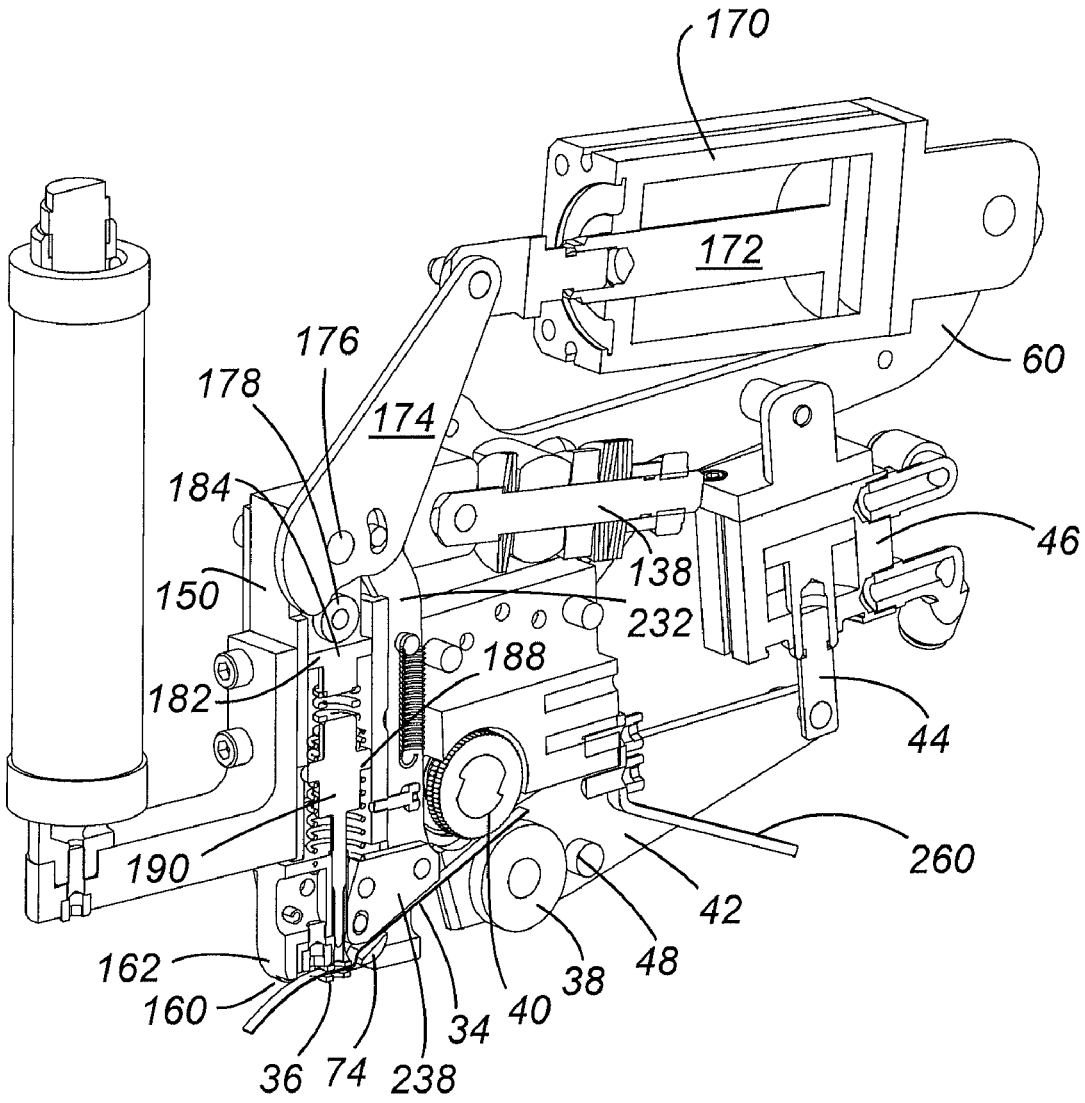
FIG. 9 is a partial perspective cross-sectional view of one embodiment of the present invention.

The band gripping and tensioning subassemblies will now be described. As a threshold step, a band 34 is wrapped around one or more objects to be bundled (the work piece) and the leading end of the band 34 is fed through a buckle 36. A band may be wrapped around the workpiece once or multiple times. For stability purposes, the work piece is typically positioned on or affixed to a mount of some sort. As a result, the operator need not worry about stabilizing the work piece but may devote full attention to operating the to tool 2. With specific reference to FIGS. 3 and 9, the tool 2 is positioned relative to the band 34 such that the leading end portion 36 of the band 34 is placed between a fixed tension wheel 38 and a movable pinch wheel 40. The pinch wheel 40 is rotatably mounted on one end of a toggle or pinch arm 42, the other end of which is connected to a piston 44 of a reciprocating pneumatic pinch cylinder 46. The pinch arm 42 is also rotatably connected to the linkage frame 30 by a pivot 48. Accordingly, as the stroke of the pneumatic cylinder 46 extends outwardly, the pinch arm 42 rotates clockwise about pivot 48 (relative to FIG. 3), and the pinch wheel 40 engages the band 34, trapping it against the tension wheel 38. A pair of symmetrical linkages 60 are positioned on and connected to opposite sides of the frame 30. One such linkage 60 is shown in FIG. 1. The linkages 60 support the pneumatic pinch cylinder 46. As would be understood by one of ordinary skill in the art, by changing the location of the pivot 48 or the length or shape of the toggle arm 42, the output force of the pneumatic pinch cylinder may be enhanced or decreased relative to the force applied by the pinch wheel 40 on the band 34. The system may also monitor, measure and output the force applied by the pinch wheel in the band. In one embodiment, the force applied to the pneumatic cylinder 46 may be measured and used to ascertain the force applied by the pinch wheel 40 on the band 34. In another embodiment, a sensor may be used to measure the travel of the piston 44 or the pinch arm 42. In either of these scenarios, the force or travel may be displayed for the benefit of the operator or used to manually stop extension of the pinch cylinder 46, or this may be done automatically. In addition, in the preferred embodiment, the tension wheel 38 is designed to engage or interact with the pinch wheel 40 at an angle, such as is illustrated in FIGS. 3 and 9. Stated differently, the non-vertical alignment of the tension wheel 38 and pinch wheel 40 provides a better pinch load and improves the ejection of the tail of the band after it is cut.

Figure 4:
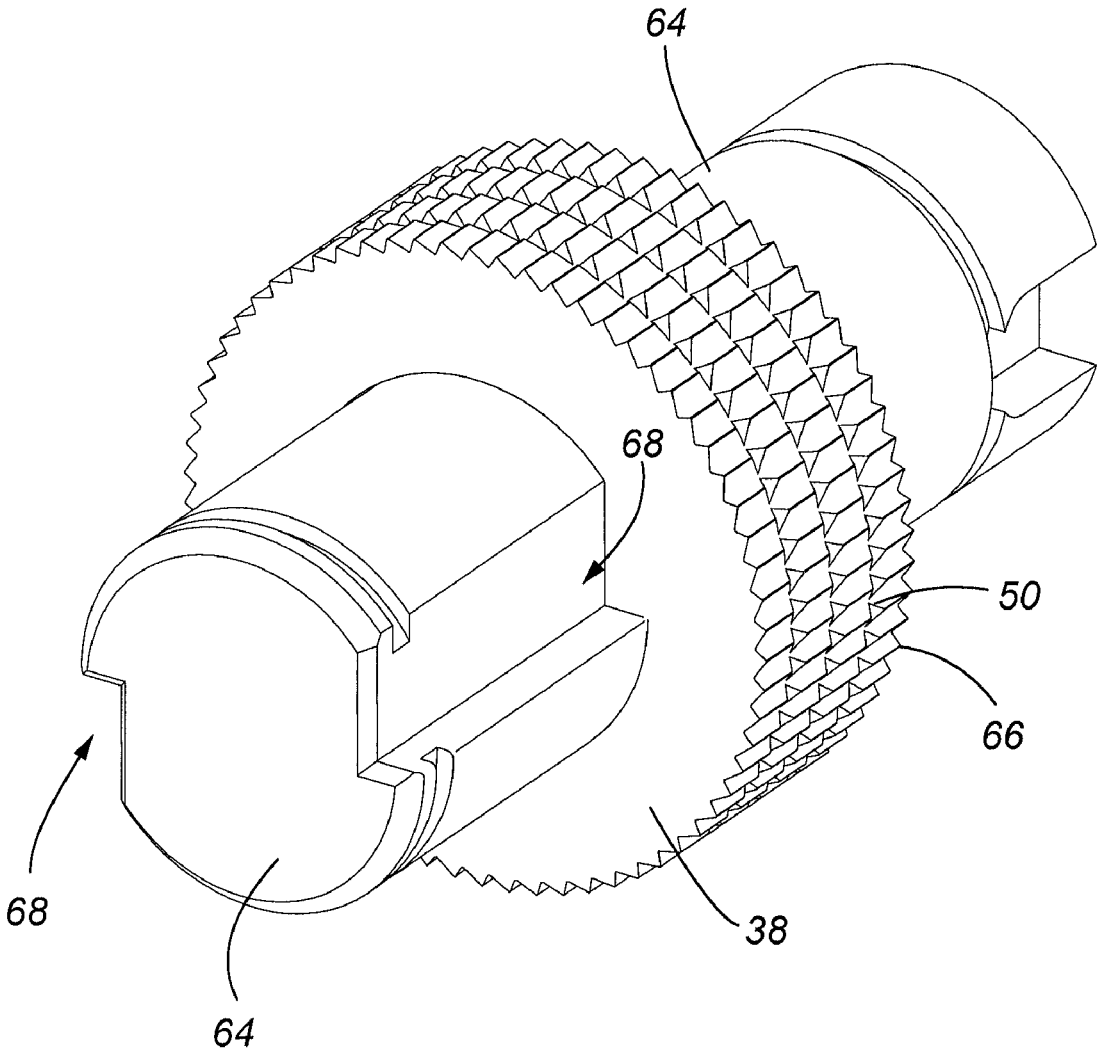
FIG. 4 is a perspective view of the tensioning wheel of one embodiment of the present invention interconnected to a tension wheel drive shaft.
Figure 5:
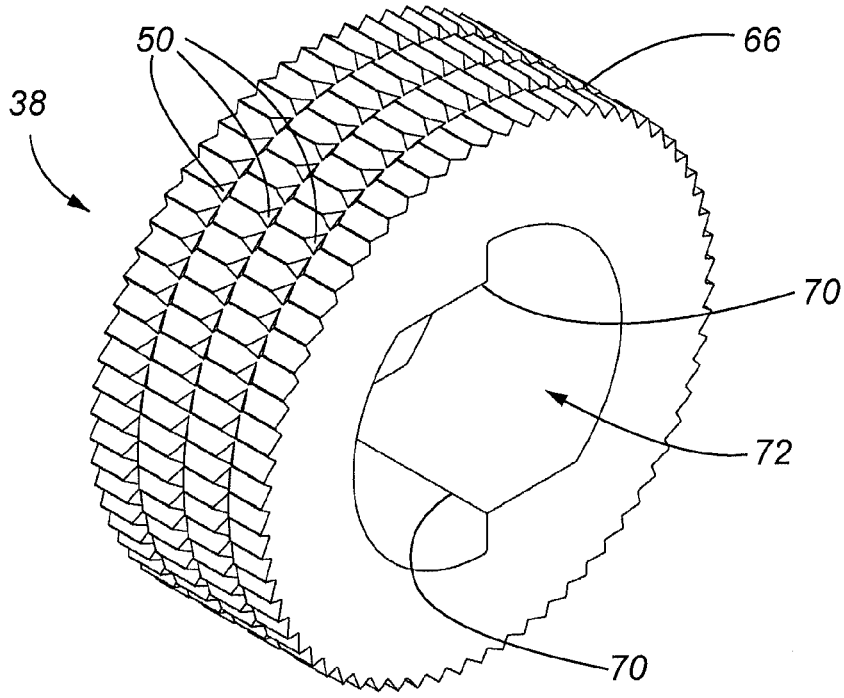
FIG. 5 is a perspective view of a tension wheel.

Referring now specifically to FIGS. 4 and 5, the tension wheel 38 of one embodiment of the present invention is shown. The tension wheel 38 is interconnected to a tension wheel drive shaft 64. The tension wheel 38 includes a textured surface, generally comprising a plurality of angled teeth 66 that facilitate gripping and tensioning of the band 34. In one embodiment of the present invention, there is a gap 50 formed between adjacent teeth 66 in order that the teeth 66 are non-continuous across the surface of the tension wheel 38 so not to create a continuous deformation along the width of the band during tensioning. The teeth 66 create a thinning of the band and may cause premature tearing or breaking of the band if the deformation caused by the teeth extended across the width of the band, particularly with an over tension initially applied to the band as part of the tightening process. The tension wheel drive shaft 64 is configured with a unique or one way interface with the tension wheel 38 to prevent an operator or technician from mounting the tension wheel 38 onto the tension wheel drive shaft 64 in the incorrect orientation. That is, cut-outs 68 are formed in the tension wheel drive shaft 64 and are configured to be one-way compatible with shoulders 70 formed in a center aperture 72 of the tension wheel 38. With this orientation, the angle of the teeth 66 are correctly positioned to properly engage the band 34.

Figure 6:
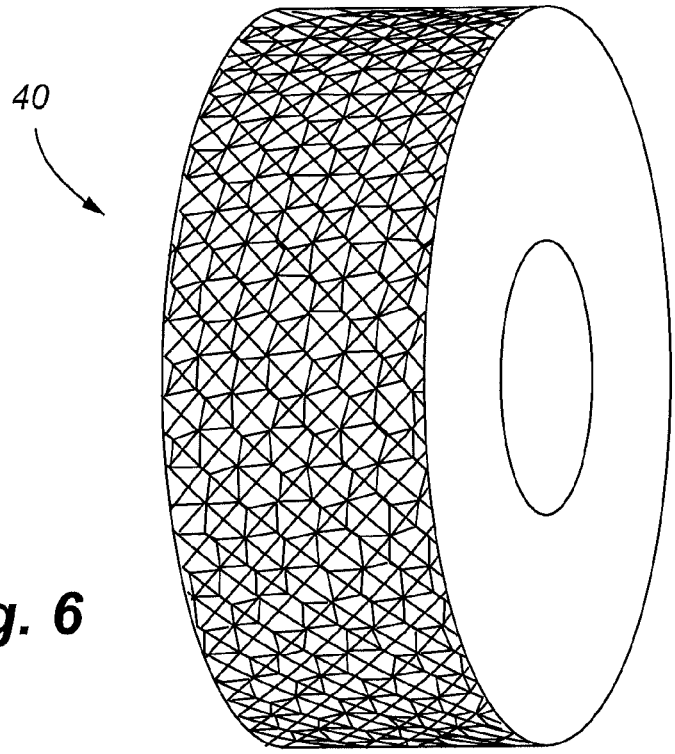
FIG. 6 is a perspective view of a pinch wheel.

Referring now to FIG. 6 in the preferred embodiment, the pinch wheel 40 includes a diamond or pyramid shaped surface. The diamond shaped surface facilitates gripping of the band and helps prevent undesirable curling of the band during tightening. The diamond shaped surface of the pinch wheel 40 cooperates with the toothed surface of the tension wheel 38 to form a gripping relationship such that the band 34 is sufficiently gripped but not subjected to a continuous deformation across its width. The textured surface of the pinch wheel 40 also cooperates with the toothed surface of the tightening wheel to help ensure that metal shavings, often generated by gripping and tensioning a band, are reduced. In the prior art, metal shavings formed by relative slipping between the band and the tensioning/gripping wheels would fill the spaces or voids in a textured surface, thereby decreasing the effectiveness of the texturing over time. In a preferred embodiment of the present invention, the apex of the pyramids of the pinch wheel 40 are offset from the edge of the teeth of the tightening wheel 38. Operating the band tightening mechanism without a band allows the offset teeth and pyramids to self-clean and remove metal shavings from the gaps between adjacent teeth and pyramids.

Referring again to FIGS. 1-3, the length of the stroke of the pneumatic pinch cylinder 46 is designed to be longer than necessary to achieve desired gripping of the band. Over time the gripping surfaces of the tension wheel 38 and the pinch wheel 40 will wear away requiring greater travel or stroke of the pneumatic cylinder rod 44 to achieve desired gripping. Thus, the additional stroke needed to properly grip the band will be available and feedback, previously described, may be provided to the operator advising of the need to check or replace either or both the tension and pinch wheels due to the additional stroke needed to grip the band.

Adjacent to and downstream of the tension wheel 38 and pinch wheel 40 is a tail guide 74 that directs an excess portion of the leading end of the band 34 away from the tool device 2 to prevent the tail from re-entering and jamming the mechanical components of the device. Indeed, one of the purposes of providing a textured surface to the pinch wheel 40 is to reduce the amount of curling of the leading edge of the band that occurs when only the tension wheel 38 is textured. With only one wheel textured, one surface of the band is cold worked and the other surface is not. This causes the band to curl. By cold working both surfaces of the band due to both wheels being textured, the band curls less and is less likely to curl in a way that would cause it to re-enter the tool.

Figure 7:
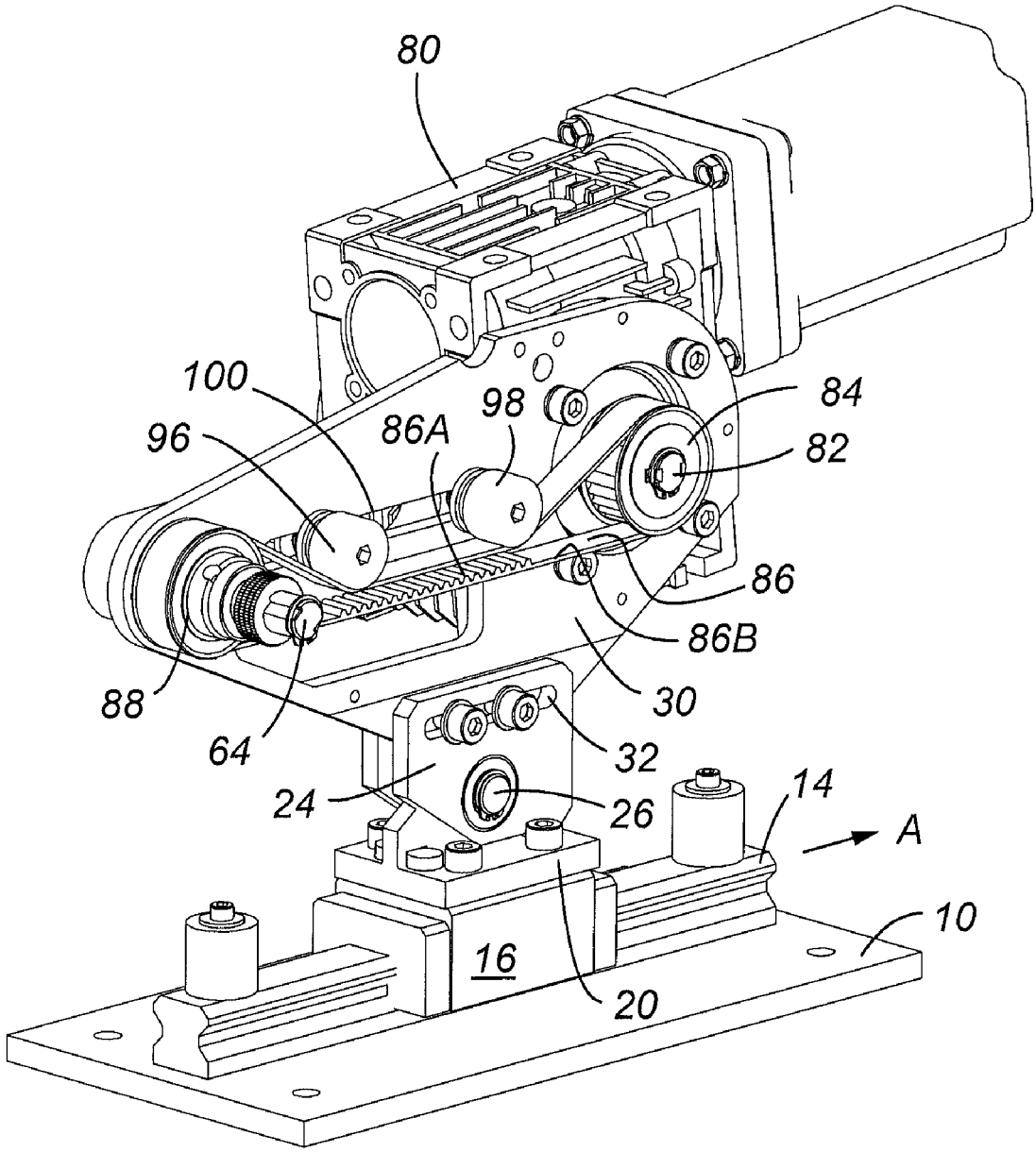
FIG. 7 is a detailed view of the frame and mounting scheme of one embodiment of the present invention, wherein the remainder of components have been removed for clarity.

Referring now to FIG. 7, the drive system for powering the tension wheel 38 is shown. A motor 80 is connected to frame 30 that directly drives drive shaft 82, which is interconnected to a drive wheel 84. A toothed belt 86 interconnects the drive wheel 84 and slave wheel 88, which is also rotatably interconnected to frame 30. The tension wheel drive shaft 64 extends from the slave wheel 88. Accordingly, the tension wheel drive shaft 64 is powered by motor 80 via belt 86.

The belt 86 is tensioned by a pair of adjustably positionable belt tensioning wheels 96 and 98. While two belt tensioning wheels are preferred, one, three or more could be used. The belt tensioning wheels 96, 98 are positioned in an elongate slot 100 formed in frame 30. The slot is positioned parallel to the path of a segment 86A of the belt 86 running between the drive wheel 84 and the slave wheel 88. Tensioning of the belt 86 is achieved by moving one or both of the belt tensioning wheels 96, 98 along the length of the slot 100, e.g. towards or away from the other belt tensioning wheel. In the embodiment of FIG. 7,. because the toothed belt 86 surrounds two wheels (drive wheel 84 and slave wheel 88), there are two belt segments 86A and 86B extending between the two wheels 84, 86. If the belt 86 surrounded three or more wheels, there would be three or more belt segments extending between the wheels and the individual belt segments may or may not be parallel to each other. According to this aspect of the present invention, the slot 100 would preferably be oriented parallel to at least one of the belt segments or at least not perpendicular to them.

Figure 7A:
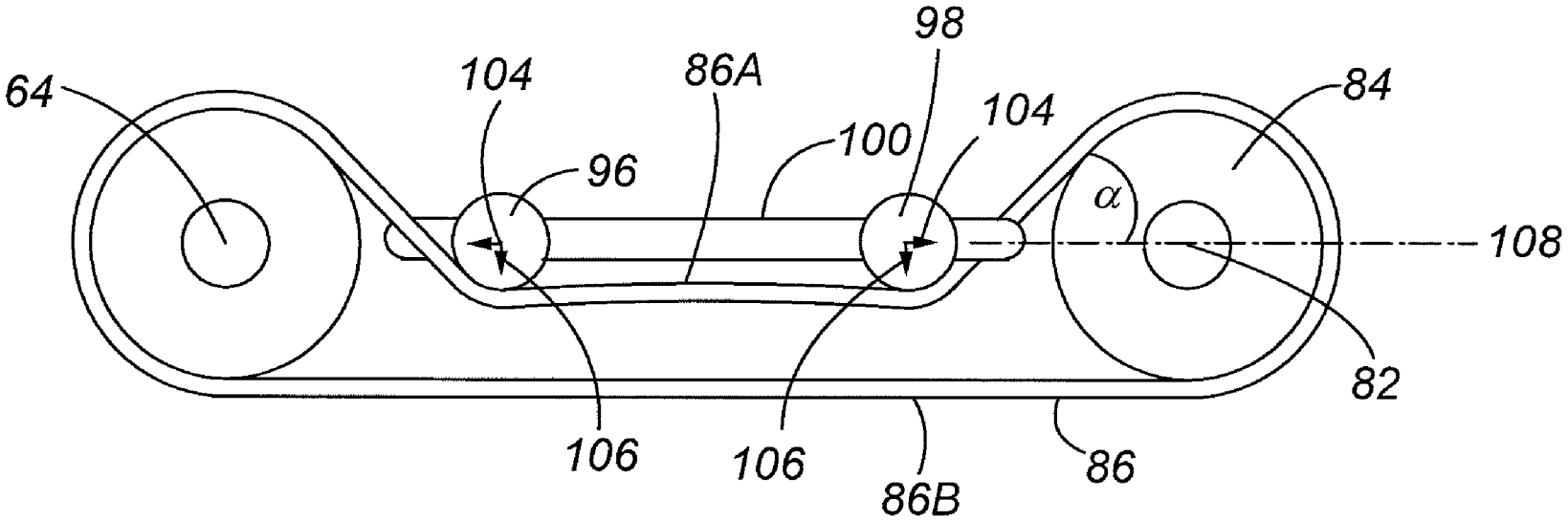
FIG. 7A is a free body diagram illustrating the function of adjustment wheels that affect the tension of a belt.

Referring now to FIG. 7A a free body diagram of the tensioning wheels 96, 98 is provided. Reaction loads acting on the belt tensioning wheels 96, 98 as a result of the belt 86 interacting with the belt tensioning wheels are shown as a horizontal reaction force 104 and a vertical reaction force 106. As the tensioning wheels 96, 98 are moved along the slot, the magnitude of the horizontal reaction force 104 and the vertical reaction force 106 will vary. In other words, as the belt tensioning wheels 96, 98 are moved outwardly in the slot 100, the angle "$\alpha$" of the belt 86 relative to a midline 108 of the slot 100 is increased and the magnitude of the reaction forces will change. In particular, the horizontal reaction force 104 will increase more than the vertical reaction force 106. By orienting the belt tensioning system in this way, parallel to a belt segment, tensioning of the belt 86 is made easier compared to systems in which the slot 100 is oriented perpendicular to the belt. For example, as the adjustment wheels 96, 98 are moved outwardly within the slot 100, the reaction force is not directly opposed to the movement of the belt tensioning wheels 104. The reaction force 106 does not impede the adjustment. Thus, one skilled in the art will appreciate that both gross and fine tuning of the tension applied to the belt 86 is enhanced because a greater range of positions exist with respect to positioning the belt tensioning wheels 96, 98 to achieve a desired tension of the belt 86. While in the preferred embodiment the slot is parallel to a belt segment, it may be oriented at an angle relative to a belt segment provided the angle is not ninety degrees or approximately that.

As shown in FIGS. 1 and 2, embodiments of the present invention also include a handle 110 with a button or switch 112 that activates the pinch cylinder 46 to grip the band. The handle 110 allows the operator to quickly and easily position the tensioning device 2 adjacent to the work piece and bands to be tensioned. When the button 112 is depressed, pinch cylinder 46 is activated to squeeze the leading portion of the band 34 between the tension wheel 38 and the pinch wheel 40. After a predetermined amount of time, when the tool is operating in an automatic mode, or after at least a second switch (not shown) is activated by the operator when the tool is operating in the semi-automatic mode, the motor 80 activates the previously described tensioning system to apply tension to the leading edge of the band 34.

Figure 8:
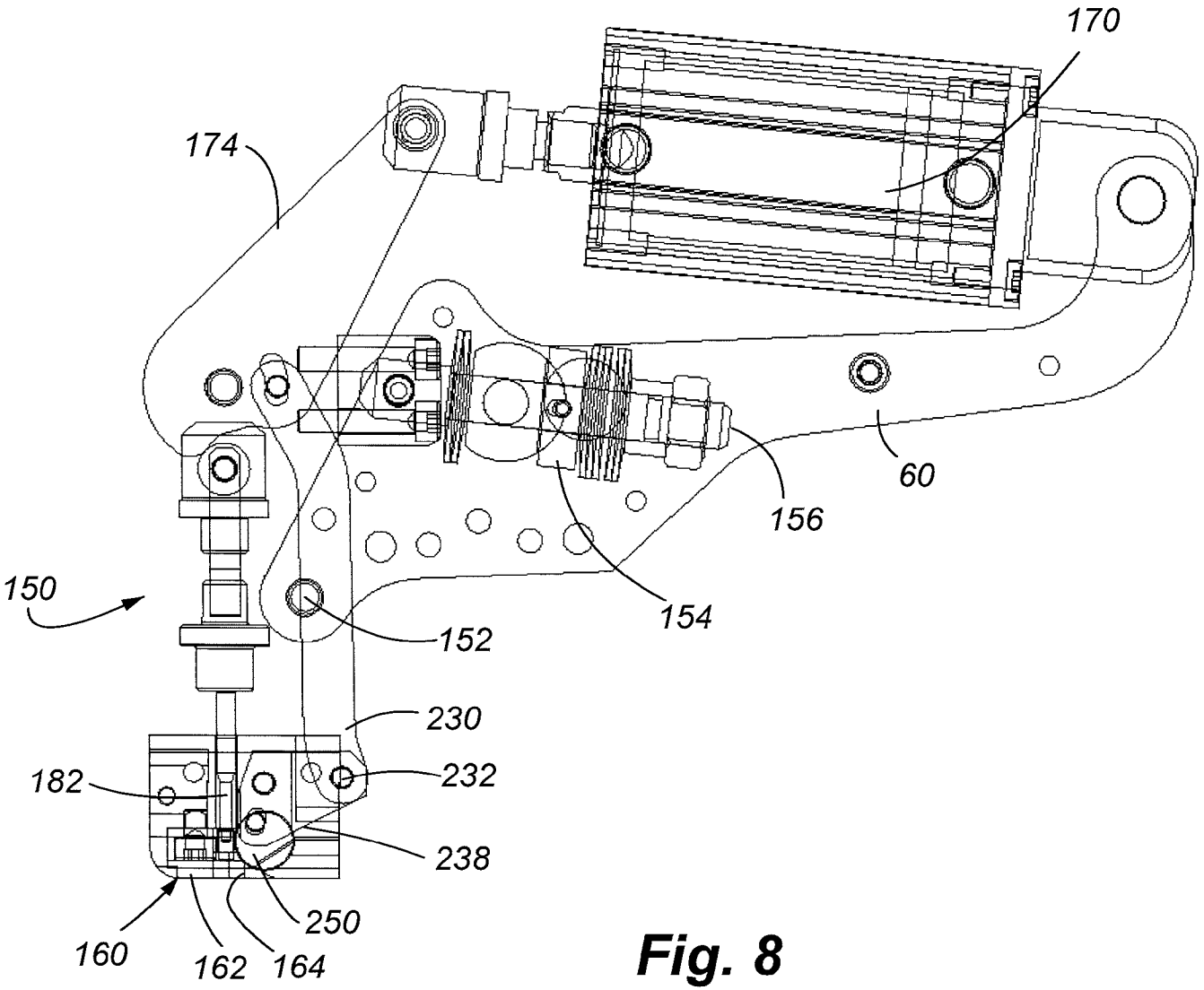
FIG. 8 is a detailed view of the impact head of one embodiment of the present invention wherein the remainder of the components have been removed for clarity.

With reference to FIGS. 3 and 8-11, an impact mechanism 150 which contains the punching and cutting subassembly mechanisms is mounted at the front of the tool 2 in the illustrated embodiment. The impact mechanism 150 is rotatably mounted between the pair of symmetrical linkages 60 via a pivot 152 (FIG. 8). The impact mechanism 150 is also interconnected to a load cell 154 via rod 156. As tension of the band 34 is increased through the gripping mechanism, the buckle 36 rests within a groove 160 formed between a pair of shoulders 162 positioned at the base of the impact mechanism 150. The leading edge of the buckle 36 abuts a stop or wall 164 as tension is increased on the band 34. Ultimately, the impact mechanism will rotate counterclockwise about the pivot 152 (as illustrated). This rotation will compress the load cell 166, thereby producing a voltage that is a function of the tension of the band 34. Typically, the band is over-tightened beyond the amount desired to account for relaxation of the band. The amount of over-tightening depends upon the band material and the workpiece. In the preferred embodiment, when the tension in the band 34 achieves a desired or predetermined level, the tightening is relaxed by reversing the rotation of the tension wheel 138 until the output of the load cell 154 is at or near the desired final tension. Of course, it should also be understood that the band need not be subject to over-tightening but that it be tensioned only to the final amount desired. A dwell time or delay may be introduced into the process at this point. The dwell time permits the band and workpiece to reach equilibrium relative to each other. For example, when the workpiece is relatively soft or when the band is wrapped multiple times about the workpiece or when the band is lubricated, there may be movement of the band or workpiece which causes the band to adjust and the tension to change. This is less likely with a hard workpiece. Regardless, if the tension changes an appreciable amount, it may be necessary to repeat the tensioning cycle. Indeed, the tensioning cycle may be repeated as many times as is necessary to achieve the desired final tension on the band.

Once the desired tension is achieved and the band and workpiece have achieved equilibrium, the pneumatic cylinder 170 is actuated, activating the punching and cutting subassemblies, explained in greater detail below. The load cell 154 allows the operator (or system software) to monitor and assess the tension applied to the band, a force profile related to the installation of a band (see FIG. 17), the force required to punch the band and lock its position relative to the buckle, the force required to cut the band, whether the band was not cut properly or not cut at all (due to, for example, incorrect tensioning of the band prior to cutting, or improperly installed parts), pawl wear, etc. If the band was not completely cut, the tail would not be ejected. This could cause a jamming of the tool. Sensors may be used to monitor ejection of the tail and could trigger a shut down of the tool if the tail is not ejected. The system may also measure the force required to preload spring 186 which can be indicative of worn parts.

When the pneumatic cylinder 170 is actuated, the cylinder rod 172 moves outwardly, causing interconnected link 174 to rotate about pivot 176. As shown in FIG. 9, the distal end of the link 174 includes a cam surface 178 which interacts with a cam follower wheel 180 that is part of the impact mechanism 150. The outward stroke of pneumatic cylinder 170 initiates punching and cutting of the band 34. One skilled in the art will appreciate that the punching and cutting of the band 34 may be automatically initiated once the tension of the band 34 reaches a desired or predetermined level, or semi-automatically by activation of a switch controlled by the tool operator.

Figure 11:
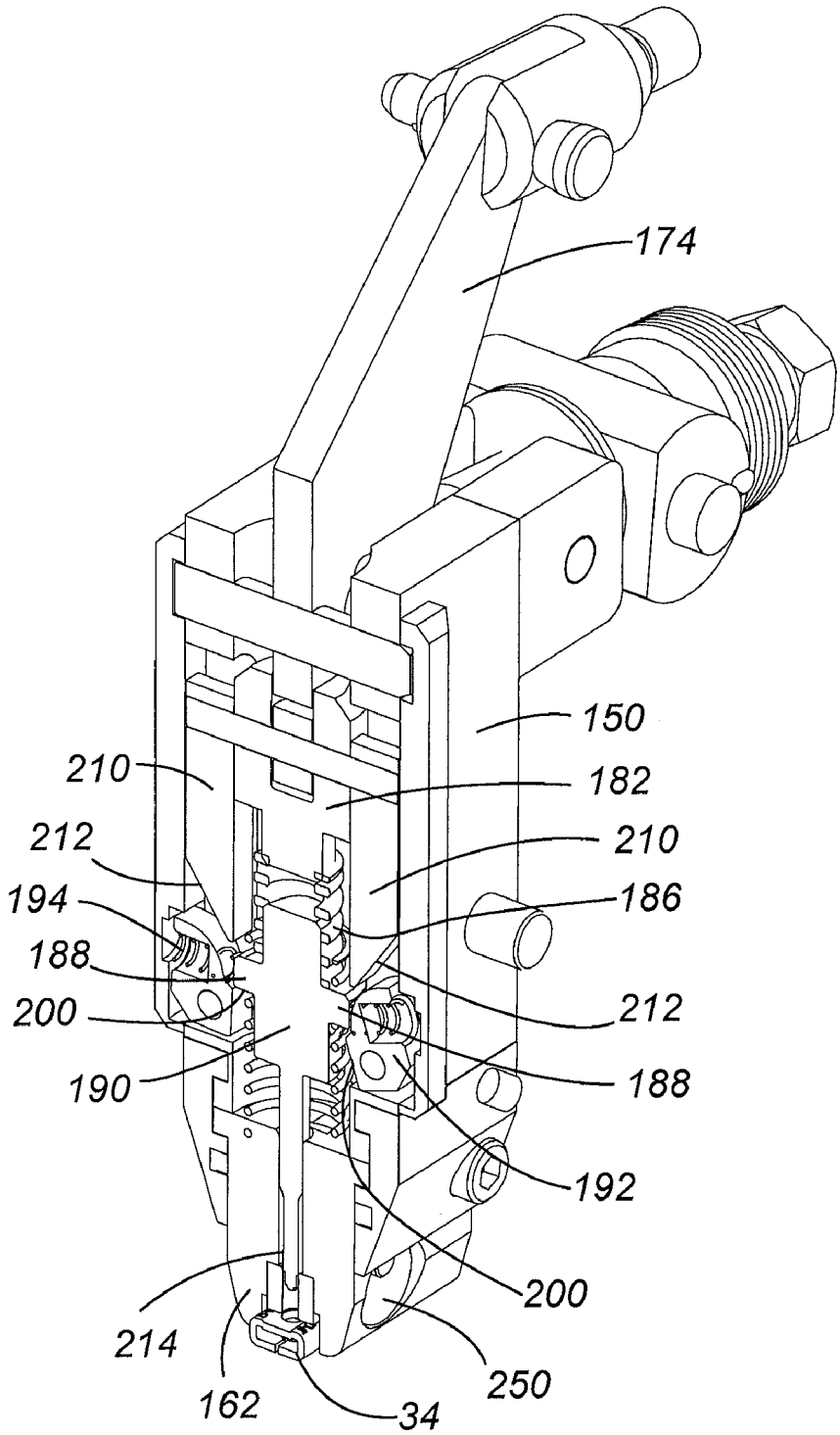
FIG. 11 is a side cross-sectional view of the impact member of one embodiment of the present invention.

As the linkage 174 rotates counterclockwise (as illustrated) due to the outward stroke of the rod 172, the cam surface 178 will push the wheel 180 downwardly, in turn forcing a plunger 182 downwardly. The plunger has an outwardly protruding flange 184 beneath which is captured a spring member 186. The spring member 186 is captured on its opposite end by a shoulder 188 formed in a punch 190. As the cam follower wheel 180 and plunger 182 are moved downwardly, the spring member 186 is loaded or energized. In order to maintain the punch 190 in a loaded condition, at least one locking pawl 192 is employed. The locking pawl 192 is biased to a locked or engaged position with the punch 190 by a biasing spring 194 holding the punch in place and resisting the expansion force of the spring member 186. In particular, as shown in FIG. 11, the locking pawl 192 has shoulders 200 that engage the bottom surface 202 of the shoulder 188 formed in the punch 190. As the linkage 174 is further rotated, impact arms 210 interconnected to the plunger 182 will contact the locking pawls 192. The impact arms 210 include an inclined surface 212 that disengage the pawls 192 from the punch 182. In turn, this causes the spring member 186 to release its energy and force the punch 182 downwardly through an opening 214 formed between the opposed shoulders 162 and into the band 34. Any force storage device may be used in place of the spring member 186. For example, anything flexible or compressible, provided it generally returns to its original shape, or a pneumatic cylinder, may be used.

Still referring to FIGS. 8-11, a cutter linkage 230 is also interconnected to linkage 174 via an integrated pin 232 that is positioned within a slot 234 formed in the linkage 174. As the pneumatic cylinder 170 is further extended and the linkage 174 further rotated, the lower most end 236 of the slot 234 engages the pin 232 to pull the cutter linkage 230 upwardly. The opposite end of the cutter linkage 230 is interconnected to a cutter arm 238 at pin 240. The cutter arm 238 pivots about pivot point 242 as the cutter linkage 230 pulls it upwardly. The cutter arm 238 also includes a slot 244 in which a pin 246 is positioned.

Figure 10:
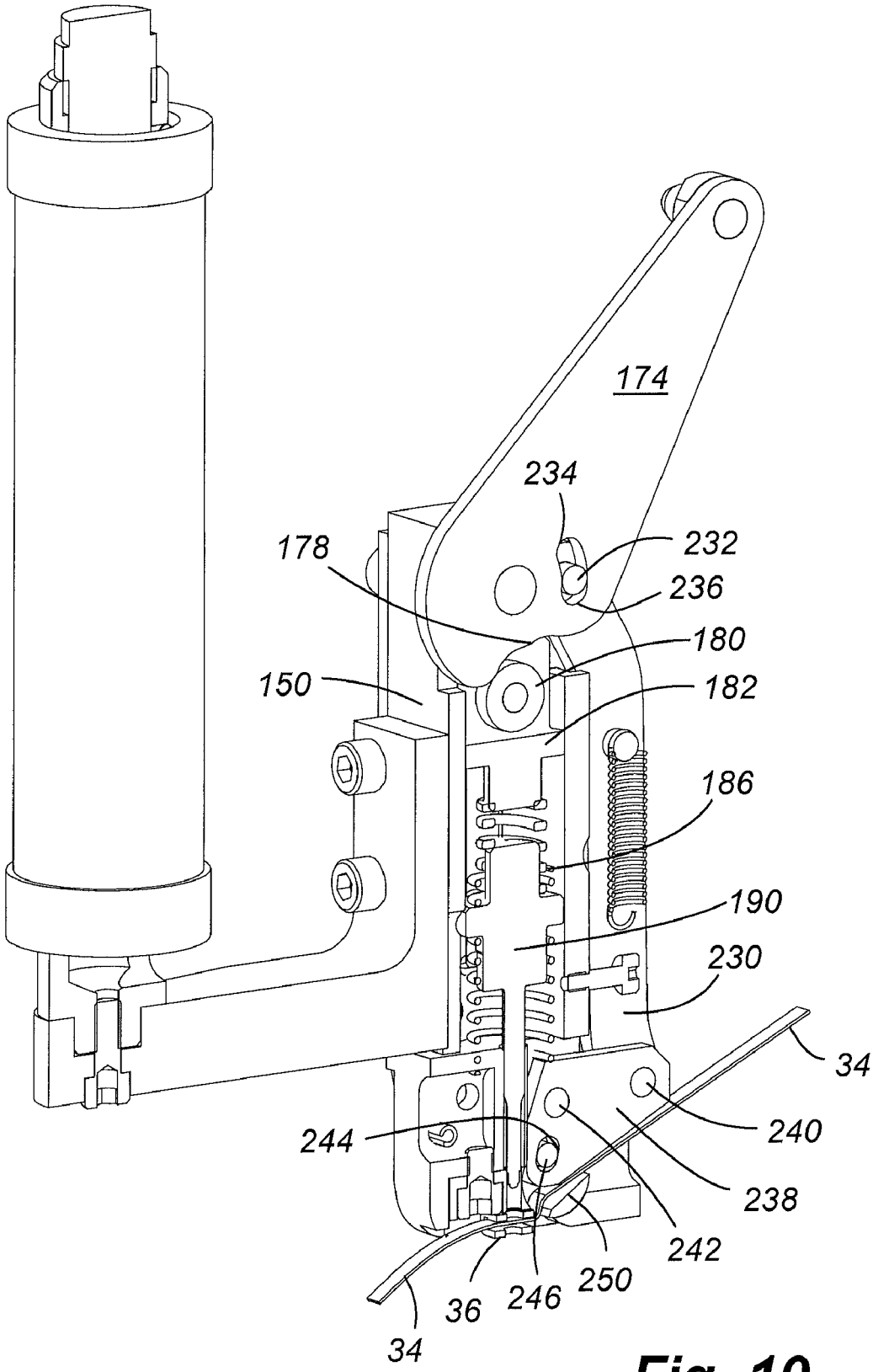
FIG. 10 is a cross-sectional view of the impact member and cam of one embodiment of the present invention.
Figure 15:
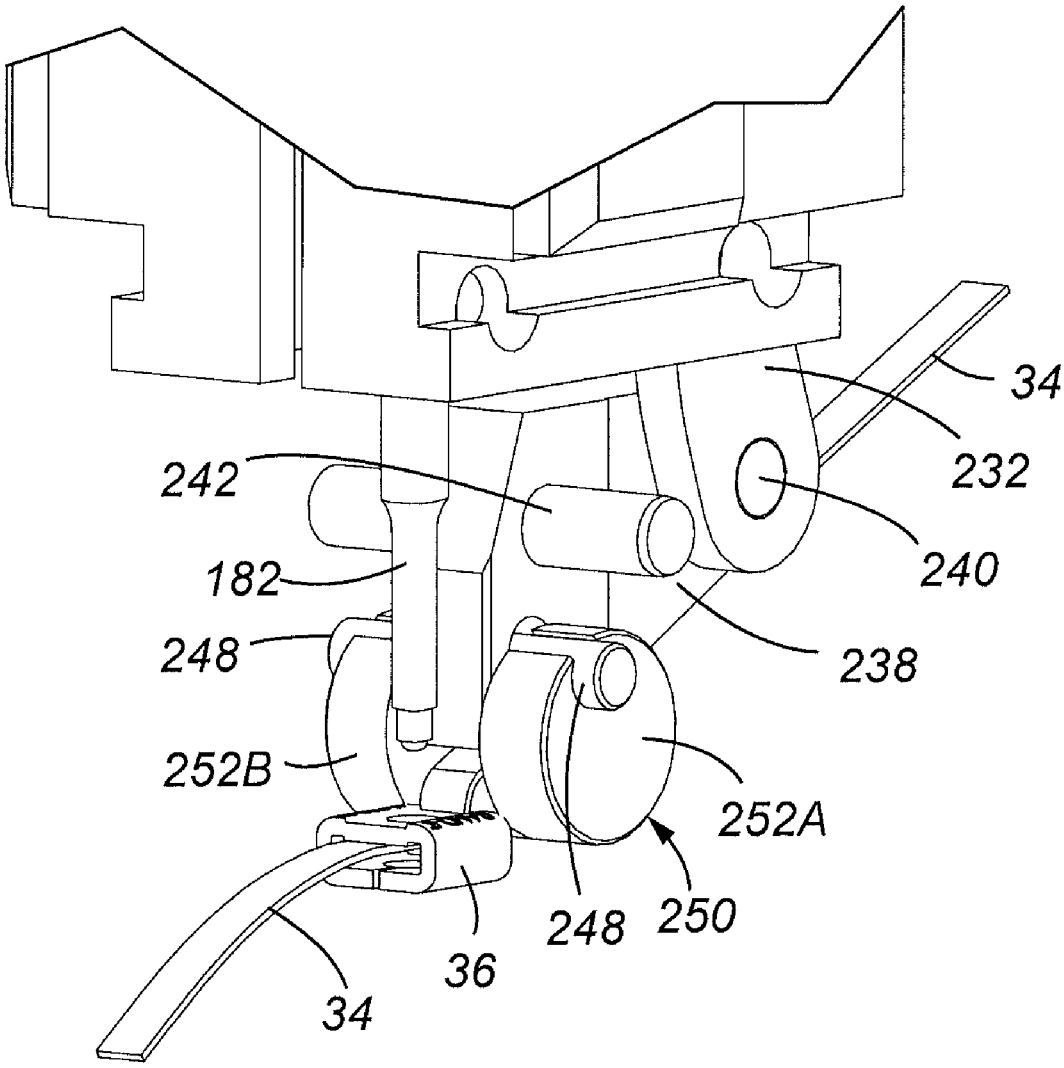
FIG. 15 is a detailed perspective view of the punch and cutting blade of one embodiment of the present invention.
Figure 16:
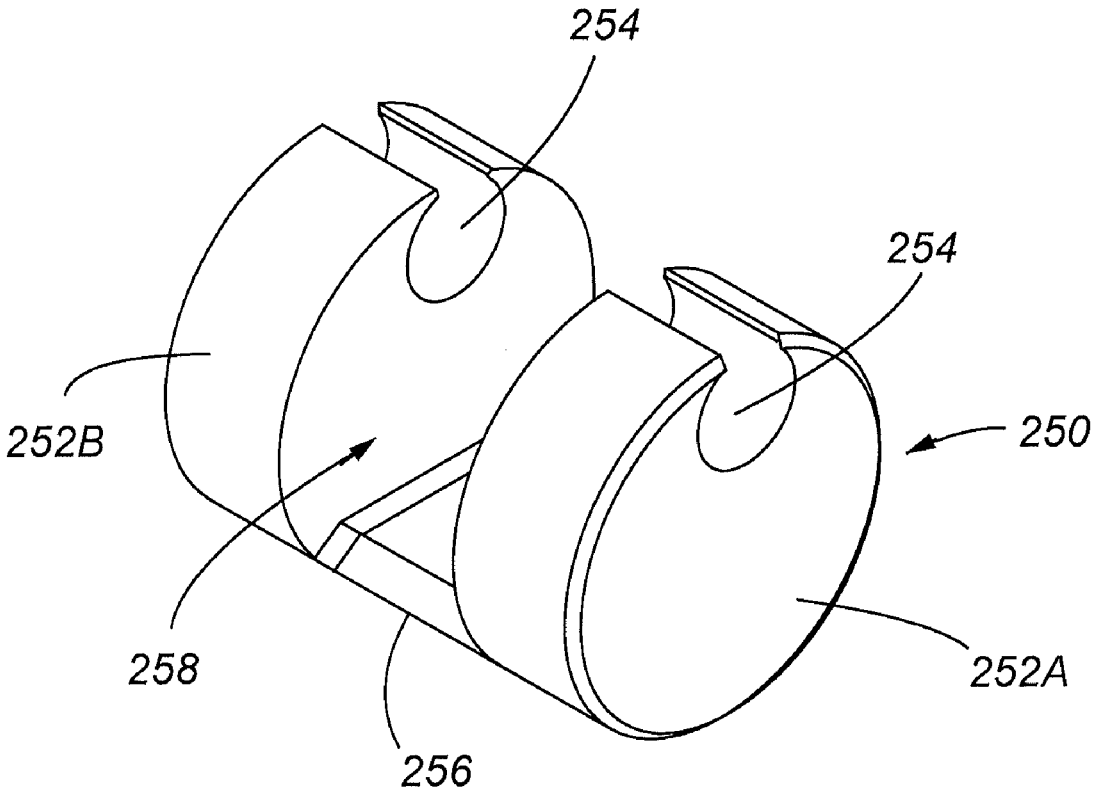
FIG. 16 is a perspective view of the cutting blade of one embodiment of the present invention.

With reference to FIGS. 15 and 16, the outer ends 248 of the pin 246 engage a cutting wheel 250, each including a pair of spaced end cylinders 252A and 252B. Each cylinder includes an aperture 254 that receives the pin 246. A knife edge 256 extends between the end cylinders 254A and 254B and engages and cuts the band 34. As the cutter arm 238 rotates counterclockwise about pivot 242, the upper end of slot 244 will engage pin 246 causing pin 246 to move downwardly (as shown in FIG. 10). In turn, this causes cutter wheel 250 (FIG. 15) to rotate clockwise forcing blade 256 to engage the underside of the band 34. As the cutting wheel 250 is rotated, its knife edge 256 will cut the excess or leading portion of the band 34 by pressing the band against the buckle. The excess portion of the band will then be transitioned between the tension wheel 38 and the pinch wheel 40, will hit the tail guide 74 (see FIG. 3) and will be directed away from and out of the tool 2. The remaining portion of the band will form a new leading edge portion adjacent to the buckle which will be folded upwardly over the buckle by the rotary movement of the cutting wheel 250. By wrapping the cut edge of the band around an edge of the buckle 36, a secondary lock is formed and the holding power of the buckle 36 is enhanced. The pneumatic cylinder 170 will then be retracted, transitioning the cutting blade 256 to a pre-cut position.

An advantage of the cutting wheel 250 is that it reduces the size and profile of the tool 2, allowing the tool 2 greater versatility in smaller spaces. By locating the blade 256 between two cylinders 252A and 252B, a slot 258 is formed and the band may extend through the slot 258 reducing the size and profile of the cutting mechanism. Further still, the rotary motion of the cutting blade also reduces the stroke and movement required to cut the band compared to the linear movement of a guillotine-type blade. Another advantage of this arrangement is that it provides a tighter, better fitting band on objects with flat surfaces. Because the leading end of the band is pulled or tensioned at an angle relative to the buckle, as shown in FIG. 10, the rotary blade 256 may be positioned on top of the flat surface of the object being clamped and underneath the leading end of the band and still have sufficient space to cut the band closely adjacent to the buckle 36. If the free end of the band was not tensioned at an angle or the blade did not cut the band from underneath, tightly banding objects with flat surfaces would be less successful.

An advantage of the punching and cutting system as described herein is that the locking and cutting functions are performed at separate times. This reduces physical shock associated with punching or deforming the band and/or buckle and severing the tail portion of the band at the same time, as done by prior art devices. More specifically, some prior art devices require a greater force be applied due to the fact that punching and cutting are performed in a single component piece of the banding tool. In some instances, the work piece is held by the operator rather than on a work piece holder. As a result, the impact or repeated impact may injure the operator or lower the quality of the operator's performance. In addition, the increased impact of the prior art devices can have two other negative consequences. It can physically damage or deform the work piece, which may cause the work piece to fail quality control inspection. Conversely, if the work piece is flexible or resilient, the impact of the tool may cause the work piece to apply a reactive force on the tool, causing the tool to recoil and potentially injure the operator. In comparison, the separate cutting function of embodiments of the present invention employs a cutting blade that rotates across the surface of the band rather than being linearly driven through the band. This requires the application of less force to the band which reduces shock on the work piece and results in a better formed cut edge.

Figure 12A:
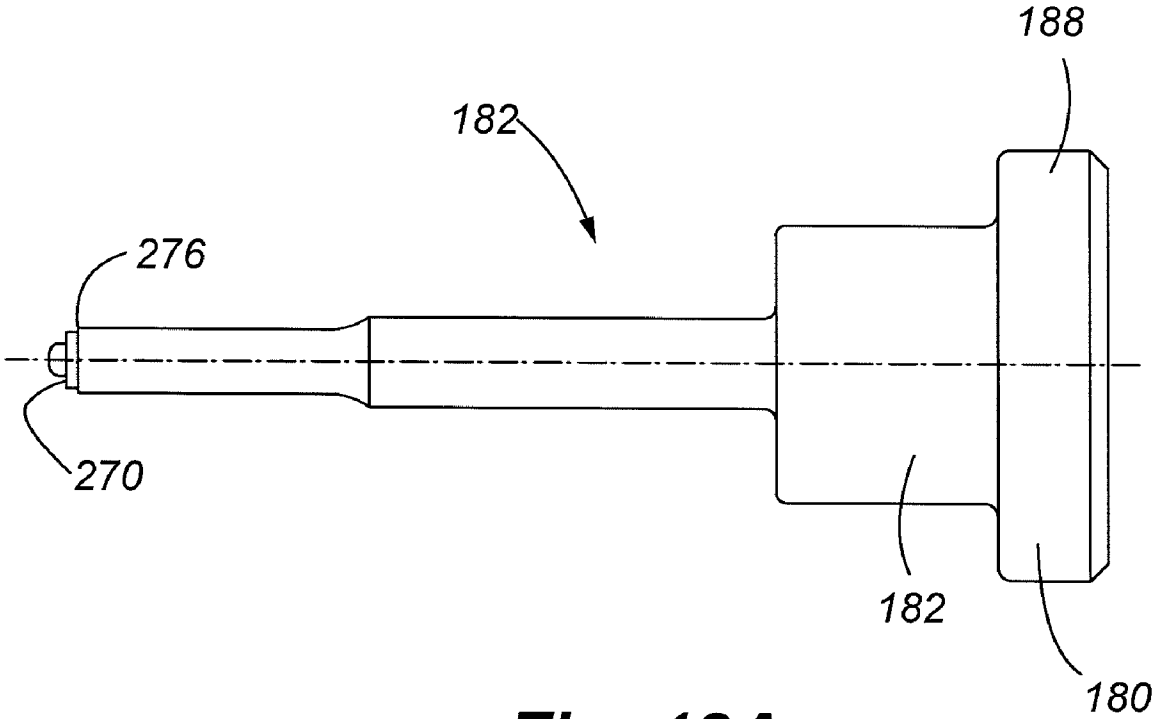
FIG. 12A is a side elevation view of the punch employed by one embodiment of the present invention.
Figure 12B:
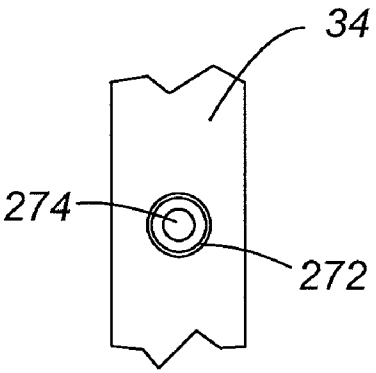
FIG. 12B is a top plan view of a dimple formed in a band by one embodiment of the present invention.
Figure 13:
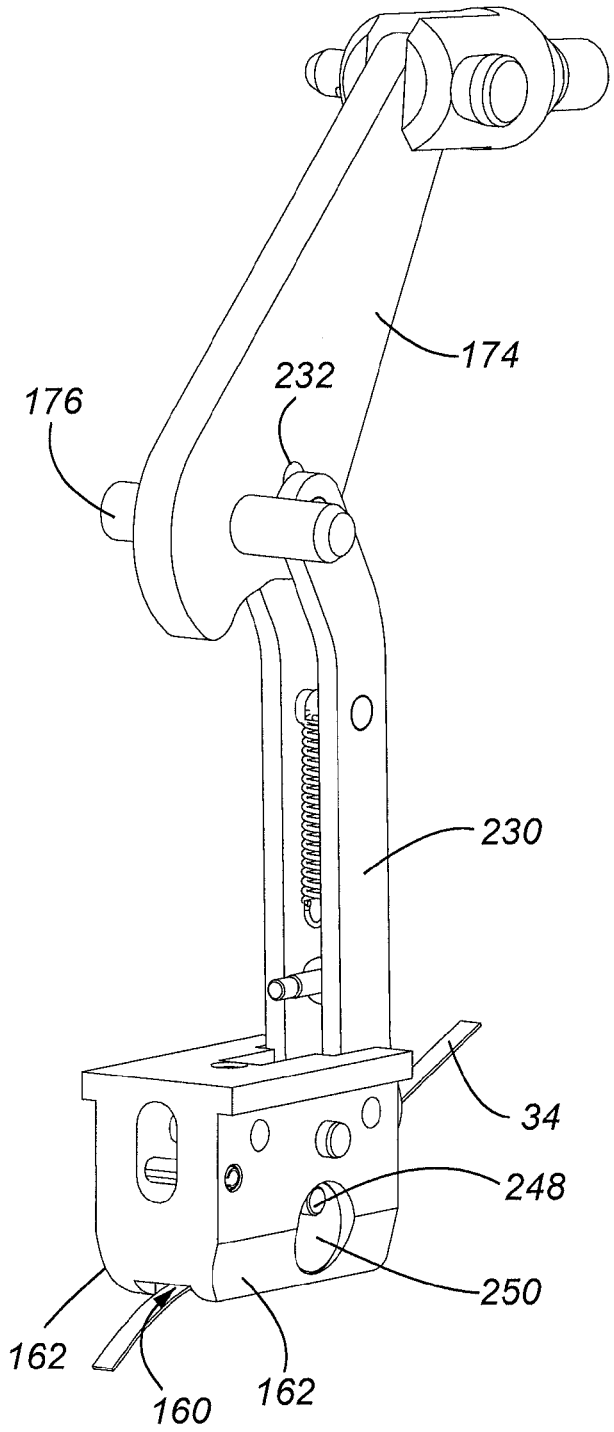
FIG. 13 is a perspective view of a cutter link and a cam of one embodiment of the present invention, the remainder of the tensioning device being omitted for clarity.
Figure 14:
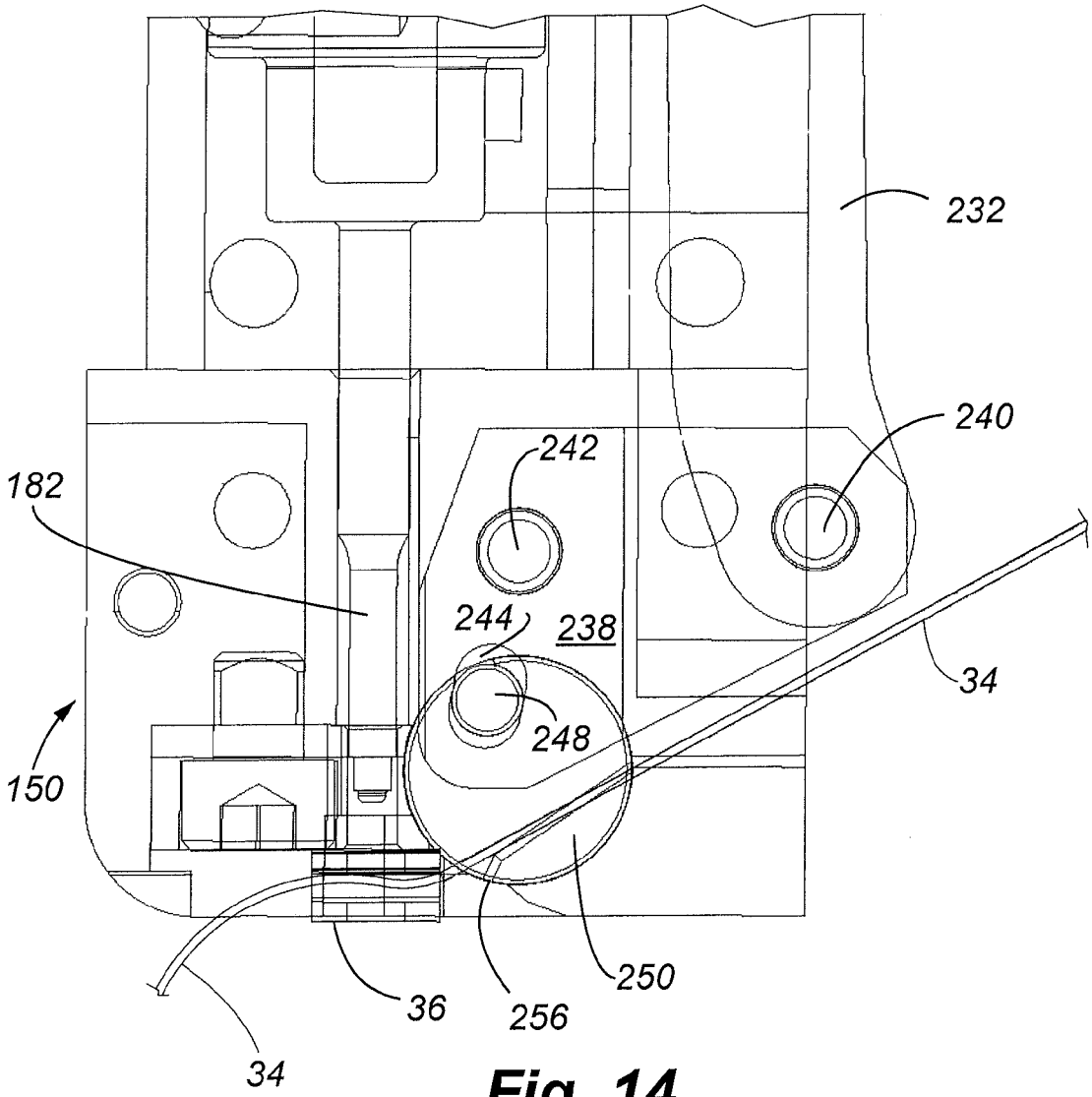
FIG. 14 is a detailed view of the cutting blade of one embodiment of the present invention.

Referring now to FIGS. 12A and 12B, another aspect of the invention is disclosed. The distal end of the punch 182 includes at least one shoulder 270. The shoulder 270, when positioned and aligned correctly relative to the band 34, will leave a ring 272 about the punched area 274 of the band 34 to indicate that the proper depth and angle relative to band was achieved. More specifically, often a preselected punch depth and orientation is required to optimize the loop tensile strength of the band and buckle. Too shallow of a punch 274 may allow the band to slip from the buckle. Conversely, deformation that is too deep may cause localized weakening or thinning in the band, thereby allowing the dimple formed by the punch to break away from the band and allow the band to slip from the buckle under the expansion forces acting on the band by the clamped workpiece. Thus, some embodiments of the present invention employ a punch 182 with a shoulder 270 that will indent the band adjacent to the dimple 274 to provide a visual indication of the proper punch depth and orientation in the form of a ring 272 around the dimple. Alternatively, still other embodiments of the present invention may employ a plurality of shoulders, for example second shoulder 276, to provide an indication of minimum and/or maximum punch depth. For example, the first shoulder will leave a mark 272, establishing that a minimum depth of dimple was achieved. However, if the second shoulder 276 also leaves a mark, the dimple is too deep and the force applied by the punch may need adjusting. The shoulder also indicates if the punch was formed perpendicularly or at an angle. For example, the shoulder indentation will not be symmetric if the punch hit the band at an angle. Preferably, the dimple that creates an ideal locking between the buckle and the band is formed by a punch that strikes the band perpendicularly.

Figure 17:
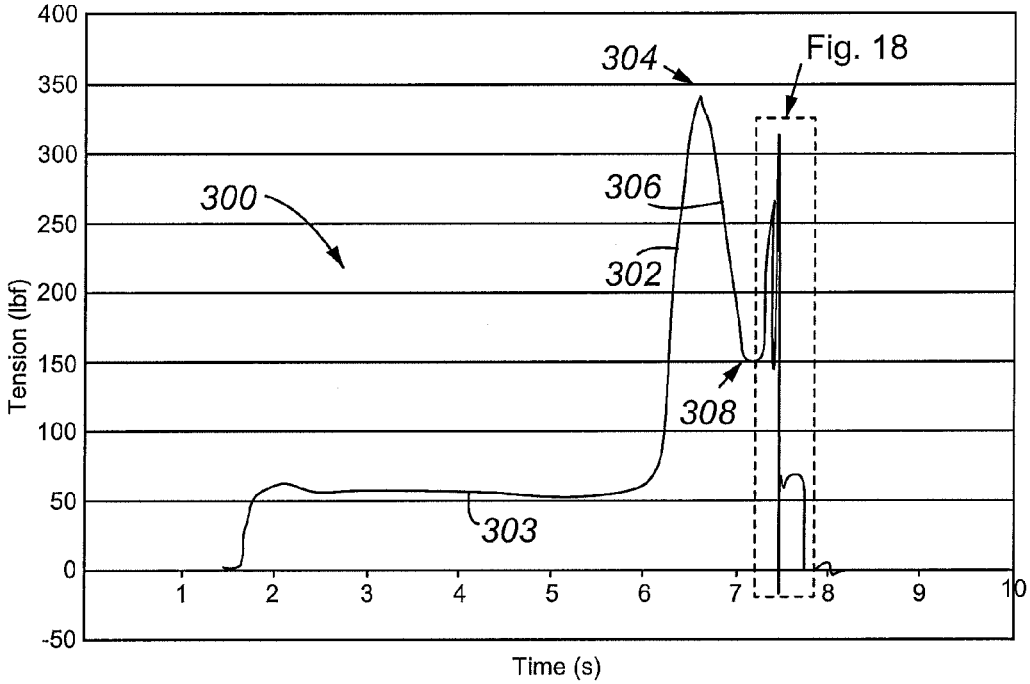
FIG. 17 is a graph showing an example of load cell output as a function of time.
Figure 18:
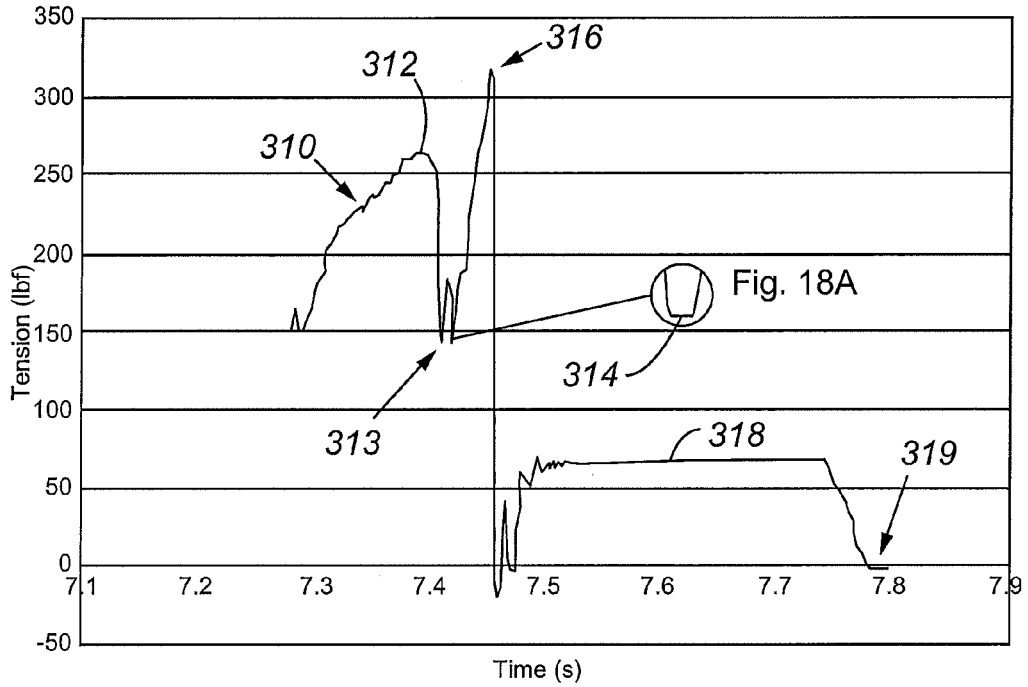
FIG. 18 is a detailed view of FIG. 17.

FIG. 17 shows an example of data 300 that may be acquired and outputted from the tool, which is assessed by the operator or the internal software of the tool. The graphs shows force as a function of time based upon the output of the load cell. Initially the band is moved by the tension wheel to reduce the diameter of the band 303. Next, tension is added 302 until a maximum tension at 304 is obtained. As shown, the maximum tension 304 is greater than the final desired tension 318. The amount of the over-tension may be smaller or zero and the rate at which the tension is applied may be varied. The tension is then relaxed at 306 by reversing the rotation of the tension wheel 38 via the belt 86 and motor 80. The tension is then held static at 308. The time of this dwell period may be adjusted and it provides time for the band and workpiece to reach equilibrium. Should there be a movement of the workpiece and/or band causing the tension to decrease, the band tightening cycle may be repeated as many times as necessary to achieve the desired final tension. With reference to FIGS. 10, 17 and 18, the activation of the punching and cutting process is shown. At 310 the linkage 174 is moving and the spring member 186 is being compressed to store energy. The impact arms 212 will then cause the locking pawls 192 to release the punch at 312, and the punch impacts the band at 313. At 314, following deformation of the band/or buckle, the value of the tension output by the load cell 154 may be less than the final desired tension shown at 308. In some instances the shock of the punch hitting the band can cause artificial tension in the band to be released, for example, tension that was not released during the dwell period at 308. Tension on the band then increases as the cutting blade 256 engages the band. The peak value at 316 is the maximum force experienced during the cutting operation. Once the band is fully cut, the tensioning mechanism is no longer connected to the band and the measured force on the band effectively goes to zero as the punch and cutting wheel is retracted at 319.

The software of the device, or the operator, may review the data 300 to ascertain the status of the band clamping operation. For example, if the maximum tension at 304 is not reached, it may indicate that the pinch wheel and/or tension wheel is not operating correctly. This may be attributed to wear in the pinch wheels, insufficient compression between the pinch wheel and the tension wheel, and/or belt slippage. Further, a tension change in the punching press is also discernible based upon the force required to compress spring member 186. An increase in the amount of tension at 312 may indicate that the punch is worn and may need to be replaced. Conversely, a decrease in the tension at 312 may anticipate a poorly formed locking dimple as the punch may have insufficient force to properly form the dimple. Additionally, an increased tension seen during cutting that exceeds the peak value at 316 may indicate that the cutting blade is working improperly. More specifically, if the increase in tension is excessive, it may indicate that the cutting blade is dull and may need replacement.

In order to ensure the data obtained or monitored by the internal programming of the device is accurate, a calibration device 350 may be periodically interconnected to the tensioning device (FIGS. 1, 2). A calibration device 350 is interconnected to the machine adjacent to the impact mechanism 150. The calibration device may include a window 352 to allow for visual inspection of a tensioned band. In operation, a band segment (not shown) is positioned in the calibration device. One end is free and the opposite end is held by a clamp (not shown). The free end is inserted between the tension wheel 38 and the pinch wheel 40 and tensioned. The clamp is in communication with a load cell contained within the calibration device. The tension of the band within the calibration tool 350 is then monitored and compared with the tension output by the load cell 154 of the device. Thus, an operator may assess whether the device is functioning within acceptable tolerances and make adjustments if not.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. A tool for tensioning a band relative to an associated buckle, the band and buckle positioned around a work piece, comprising:

a frame;

a tensioning wheel rotatably fixed relative to said frame, said tensioning wheel adapted to engage a first surface of a band;

a drive source operatively associated with said tensioning wheel to provide rotational motion to said tensioning wheel;

a toggle arm having a first end and a second end, said toggle arm pivotally connected to said frame at a point between said first and second ends;

a pinch wheel rotatably fixed to said first end of said toggle arm, said tension wheel adapted to engage a second surface of the band;

a first pneumatically actuated cylinder connected to said second end of said toggle arm, said first pneumatically actuated cylinder having a finite length of travel and outputting a finite force;

wherein the pivoting toggle arm increases the force applied by the pinch wheel on the band to an amount greater than the output force of the first pneumatically actuated cylinder;

wherein said tension wheel has a textured surface in the form of a toothed pattern and said pinch wheel has a textured surface for engaging the band; and wherein each tooth formed on said toothed pattern of said tension wheel has an edge that engages the band, and wherein no edge is continuous across the width of said tension wheel.

2. The tool of claim 1, wherein said force applied by the pinch wheel is generated by utilizing less than a full length of travel of the first pneumatically actuated cylinder and a remaining length of travel of the first pneumatically actuated cylinder is utilized to maintain said force applied in the event the diameter of said pinch wheel decreases due to wear.

3. The tool of claim 1, wherein said textured surface of said tension wheel is different from said textured surface of said pinch wheel.

4. The tool of claim 1, wherein said textured surface of said pinch wheel is in the form of a diamond pattern.

5. The tool of claim 1, wherein said textured surface of said tension wheel and said textured surface of said pinch wheel engage the band in a staggered fashion.

6. The tool of claim 1, wherein the tension wheel and pinch wheel are not vertically aligned.

7. The tool of claim 1, further comprising a drive system for driving the rotation of the tensioning wheel, the drive system comprising:

a motor;

a drive wheel interconnected to said motor and being driven by said motor;

a belt operatively associated with said tensioning wheel and said drive wheel to impart rotation to said tensioning wheel; and a tensioning idler wheel for adjusting the tension of said belt, said tensioning idler wheel adjustably positionable along a linear path that is generally parallel to the path of a portion of the belt engaged by the tensioning idler wheel.

8. The tool of claim 7, wherein said tensioning idler wheel engages said belt at an acute angle relative to said path of said belt engaged by said tensioning idler wheel.

9. The tool of claim 7, wherein said path on which said tensioning idler wheel is positionable is parallel to a line intersecting the axis of rotation of said tensioning wheel and said drive wheel.

10. The tool of claim 1, further comprising apparatus for locking the band relative to the buckle and for cutting the band, comprising:

a head rotatably fixed relative to said frame, said head adapted to engage a buckle associated with the band;

a punch at least partially disposed within said head, said punch having a first position wherein the punch is positioned away from the band and buckle and a second position wherein said punch engages the band and/or the buckle to lock the position of the band relative to the buckle; and a cutting blade for severing an excess length of the band, said cutting blade positioned relative to the band wherein said movement of said blade cuts the band and bends the band about the buckle.

11. The tool of claim 10, wherein said cutting blade is a cylindrical rotary blade.

12. The tool of claim 11, wherein said cylindrical rotary blade is positioned underneath the excess length of band.

13. The tool of claim 12, wherein said cutting blade comprises a first cylinder spaced from a second cylinder with a blade therebetween.

14. The tool of claim 10, wherein the actuation of said punch is separate from the actuation of said cutting blade.

15. The tool of claim 14, wherein said punch and said cutting blade are actuated by movement of a cam.

16. The tool of claim 15, wherein said punch and said cutting blade are actuated by movement of the same cam.

17. The tool of claim 10, wherein said punch has a first portion having a first thickness and a second portion having a second thickness and said second thickness is greater than said first thickness to define a shoulder between said first portion and said second portion.

18. The tool of claim 10, wherein said punch comprises a first shoulder portion that forms a mark in surface of the band as part of the punching operation.

19. The tool of claim 18, wherein the mark is indicative of the quality of the punching operation.

20. The tool of claim 18, wherein the mark is in the shape of a ring.

21. The tool of claim 18, wherein the punch forms a dimple in the band and the mark is indicative of the depth of the dimple.

22. The tool of claim 18, wherein said punch further comprises a second shoulder portion spaced from the first shoulder portion.

23. The tool of claim 22, wherein said first shoulder portion and said second shoulder portion each leaves a mark in the band.

24. The tool of claim 10, further comprising a load measuring element associated with said frame and said head that measures the tension applied to the band by said tensioning wheel.

25. The tool of claim 24, wherein the load measuring element outputs data related to at least one of maximum tension applied to the band, the force applied by said punch on the band during the punching operation and the tension on the band when said cutting blade cuts the band.

26. The tool of claim 25, wherein the output of the load measuring element is provided to a remote monitoring system, and said remote monitoring system outputs data regarding at least one of operation and maintenance of the tool.

27. The tool of claim 26, wherein the output of the monitoring system is at least one of visual and audible.

28. The tool of claim 10, further comprising:

a second pneumatically actuated cylinder interconnected to a cam, said cam having a cam surface, said second pneumatically actuated cylinder having a rod that moves between a first retracted position and a second extended position, wherein movement of said rod causes movement of said cam and said cam surface;

a spring member positioned between said cam surface and said punch, wherein movement of said rod from said first position to a first intermediate position stores energy in the spring;

a release member positioned between said cam surface and said punch, wherein movement of said rod from said first intermediate position to a second intermediate position releases the energy in said spring member;

a linkage positioned between said cam surface and said cutting blade, wherein movement of said rod from said second intermediate position to said second position causes said cutting blade to cut said band.

29. The tool of claim 28, further comprising at least one pawl associated with said punch that has a first position in which said punch is prevented from moving while energy is stored in said spring member and a second position in which said punch is not prevented from moving.

30. The tool of claim 29, wherein said release member travels between a first position and a second position, and wherein said release member engages said at least one pawl when traveling from said first position to said second position and causes said at least one pawl to move to said second position.

31. The tool of claim 1, further comprising an elongate rail upon which the frame is pivotally associated with wherein said tool may slide along said rail and pivot relative to said rail.

32. The tool of claim 1, wherein said pinch wheel has a first position and a second position based upon the position of said toggle arm, and in said second position said pinch wheel engages the band, further comprising a lock to fix said pinch wheel in said second position.

33. The tool of claim 32, wherein said lock is manually actuated by an operator or automatically actuated based upon the force applied by said first pneumatically actuated cylinder.

34. A tool for tensioning and locking a band about a work piece, said band having a leading end and an opposite end and a buckle associated with said band proximate said opposite end of said band, comprising: a frame; a head interconnected to said frame, said head further comprising means for securing said buckle; means for deforming said band disposed within said head; gripping means for gripping said leading end of said band; tightening means for tightening said band about said work piece; cutting means for removing said leading end of said band after said band is deformed by said means for deforming and for bending a remaining portion of said band about said buckle; and actuating means for sequentially causing said means for deforming to deform said band and said cutting means to remove said leading end of said band and bend a remaining portion of said band about said buckle.

35. A tool for tensioning a band relative to an associated buckle, the band and buckle positioned around a work piece, comprising:

a frame;

a tensioning wheel rotatably fixed relative to said frame, said tensioning wheel adapted to engage a first surface of a band;

a drive source operatively associated with said tensioning wheel to provide rotational motion to said tensioning wheel;

a toggle arm having a first end and a second end, said toggle arm pivotally connected to said frame at a point between said first and second ends;

a pinch wheel rotatably fixed to said first end of said toggle arm, said tension wheel adapted to engage a second surface of the band;

a first pneumatically actuated cylinder connected to said second end of said toggle arm, said first pneumatically actuated cylinder having a finite length of travel and outputting a finite force;

wherein the pivoting toggle arm increases the force applied by the pinch wheel on the band to an amount greater than the output force of the first pneumatically actuated cylinder; and a drive system for driving the rotation of the tensioning wheel, the drive system comprising:

a motor;

a drive wheel interconnected to said motor and being driven by said motor;

a belt operatively associated with said tensioning wheel and said drive wheel to impart rotation to said tensioning wheel; and a tensioning idler wheel for adjusting the tension of said belt, said tensioning idler wheel adjustably positionable along a linear path that is generally parallel to the path of a portion of the belt engaged by the tensioning idler wheel.

36. The tool of claim 35, wherein said tensioning idler wheel engages said belt at an acute angle relative to said path of said belt engaged by said tensioning idler wheel.

37. The tool of claim 35, wherein said path on which said tensioning idler wheel is positionable is parallel to a line intersecting the axis of rotation of said tensioning wheel and said drive wheel.

38. A tool for tensioning a band relative to an associated buckle, the band and buckle positioned around a work piece, comprising:

a frame;

a tensioning wheel rotatably fixed relative to said frame, said tensioning wheel adapted to engage a first surface of a band;

a drive source operatively associated with said tensioning wheel to provide rotational motion to said tensioning wheel;

a toggle arm having a first end and a second end, said toggle arm pivotally connected to said frame at a point between said first and second ends;

a pinch wheel rotatably fixed to said first end of said toggle arm, said tension wheel adapted to engage a second surface of the band;

a first pneumatically actuated cylinder connected to said second end of said toggle arm, said first pneumatically actuated cylinder having a finite length of travel and outputting a finite force; and wherein the pivoting toggle arm increases the force applied by the pinch wheel on the band to an amount greater than the output force of the first pneumatically actuated cylinder; and an apparatus for locking the band relative to the buckle and for cutting the band, comprising:

a head rotatably fixed relative to said frame, said head adapted to engage a buckle associated with the band;

a punch at least partially disposed within said head, said punch having a first position wherein the punch is positioned away from the band and buckle and a second position wherein said punch engages the band and/or the buckle to lock the position of the band relative to the buckle; and a cutting blade for severing an excess length of the band, said cutting blade positioned relative to the band wherein said movement of said blade cuts the band and bends the band about the buckle.

39. The tool of claim 38, wherein said cutting blade is a cylindrical rotary blade.

40. The tool of claim 39, wherein said cylindrical rotary blade is positioned underneath the excess length of band.

41. The tool of claim 40, wherein said cutting blade comprises a first cylinder spaced from a second cylinder with a blade therebetween.

42. The tool of claim 38, wherein the actuation of said punch is separate from the actuation of said cutting blade.

43. The tool of claim 42, wherein said punch and said cutting blade are actuated by movement of a cam.

44. The tool of claim 43, wherein said punch and said cutting blade are actuated by movement of the same cam.

45. The tool of claim 38, wherein said punch has a first portion having a first thickness and a second portion having a second thickness and said second thickness is greater than said first thickness to define a shoulder between said first portion and said second portion.

46. The tool of claim 38, wherein said punch comprises a first shoulder portion that forms a mark in surface of the band as part of the punching operation.

47. The tool of claim 46, wherein the mark is indicative of the quality of the punching operation.

48. The tool of claim 46, wherein the mark is in the shape of a ring.

49. The tool of claim 46, wherein the punch forms a dimple in the band and the mark is indicative of the depth of the dimple.

50. The tool of claim 46, wherein said punch further comprises a second shoulder portion spaced from the first shoulder portion.

51. The tool of claim 50, wherein said first shoulder portion and said second shoulder portion each leaves a mark in the band.

52. The tool of claim 38, further comprising a load measuring element associated with said frame and said head that measures the tension applied to the band by said tensioning wheel.

53. The tool of claim 52, wherein the load measuring element outputs data related to at least one of maximum tension applied to the band, the force applied by said punch on the band during the punching operation and the tension on the band when said cutting blade cuts the band.

54. The tool of claim 53, wherein the output of the load measuring element is provided to a remote monitoring system, and said remote monitoring system outputs data regarding at least one of operation and maintenance of the tool.

55. The tool of claim 54, wherein the output of the monitoring system is at least one of visual and audible.

56. The tool of claim 38, further comprising:

a second pneumatically actuated cylinder interconnected to a cam, said cam having a cam surface, said second pneumatically actuated cylinder having a rod that moves between a first retracted position and a second extended position, wherein movement of said rod causes movement of said cam and said cam surface;

a spring member positioned between said cam surface and said punch, wherein movement of said rod from said first position to a first intermediate position stores energy in the spring;

a release member positioned between said cam surface and said punch, wherein movement of said rod from said first intermediate position to a second intermediate position releases the energy in said spring member;

a linkage positioned between said cam surface and said cutting blade, wherein movement of said rod from said second intermediate position to said second position causes said cutting blade to cut said band.

57. The tool of claim 56, further comprising at least one pawl associated with said punch that has a first position in which said punch is prevented from moving while energy is stored in said spring member and a second position in which said punch is not prevented from moving.

* * * * *